US012742384B1

(12) United States Patent
Pogrebinsky

(10) Patent No.: US 12,742,384 B1
(45) Date of Patent: Sep. 22, 2026

(54) HYDROSTATICALLY BALANCED MODULATOR ASSEMBLY AND ASSOCIATED METHOD FOR MUD PULSE TELEMETRY

(71) Applicant: Michael Simon Pogrebinsky, Houston, TX (US)

(72) Inventor: Michael Simon Pogrebinsky, Houston, TX (US)

( * ) Notice: Subject to any disclaimer, the term of this patent is extended or adjusted under 35 U.S.C. 154(b) by 0 days.

(21) Appl. No.: 19/314,537

(22) Filed: Aug. 29, 2025

(51) Int. Cl.
*E21B 47/18* (2012.01)

(52) U.S. Cl.
CPC ..... *E21B 47/18* (2013.01)

(58) Field of Classification Search
CPC ..... E21B 43/18; E21B 43/20; E21B 43/22; E21B 43/24
See application file for complete search history.

(56) References Cited

U.S. PATENT DOCUMENTS 5,020,609 A * 6/1991 Jeter ..... E21B 47/22 175/320
10,428,582 B1 * 10/2019 Anderson ..... E21B 4/02
12,529,305 B1 * 1/2026 Richards ..... E21B 47/18
2002/0070368 A1 * 6/2002 Rountree ..... E21B 47/18 251/30.01
2002/0117306 A1 * 8/2002 Hahn ..... E21B 47/18 166/373
2017/0074092 A1 * 3/2017 Pogrebinsky ..... E21B 47/18
2021/0189873 A1 * 6/2021 Peters ..... E21B 47/20

* cited by examiner

*Primary Examiner* — David Carroll
(74) *Attorney, Agent, or Firm* — McCarter & English, LLP

(57) ABSTRACT

A hydrostatically compensated modulator assembly and method for generating pressure wave fluctuations in drilling fluid flow are disclosed, enabling advanced downhole telemetry. The assembly includes a housing, fluid passages, a hydraulic oil-filled chamber, and reciprocating members operatively connected to obstruction portions that modulate flow by transmitting lateral movement while allowing axial freedom. Kinetic energy from drilling fluid is diverted to the chamber body, reducing stress on moving actuator components. A piston is positioned at the lower chamber portion with its base directly exposed to drilling fluid, maintaining approximate hydrostatic balance between oil pressure in the chamber and drilling fluid pressure outside. A motor and gearbox-driven actuator enables high-speed signal generation. A programmable controller provides adaptive signal encoding, telemetry management, and direct interface with surface equipment via downlinking, allowing real-time adjustment of encoding schemes and operational parameters. The invention advances durability, reliability, energy efficiency, and data rates for mud pulse telemetry.

20 Claims, 18 Drawing Sheets

HYDROSTATICALLY BALANCED MODULATOR ASSEMBLY AND ASSOCIATED METHOD FOR MUD PULSE TELEMETRY

TECHNICAL FIELD

The present invention relates to drilling wells, and more specifically to transmitting downhole information to the surface. The present disclosure also relates to a telemetry system incorporating a reciprocating hydraulically balanced modulator assembly for generating pressure wave signals in the drilling fluids within a drill string.

BACKGROUND

Drilling fluid telemetry systems, known as mud pulse telemetry systems, generate pressure wave fluctuations in the drilling mud by restricting fluid flow in the drill string. There are three groups of pulsers which are generally used in positive pulse signals telemetry systems. The first group uses restrictors that move along the well bore axis. Pulsers of this group are known as poppet-based pulsers. Their main advantage is relatively low energy consumption. However, this type of pulser does not allow control of the restrictor positions in time with the accuracy required for various methods based on the signal modulations schemes. The second group of pulsers uses rotors that move in the plane perpendicular to the well bore axis. This group of pulsers is able to achieve better control of the rotor positions in time, but these pulsers are characterized by higher energy consumption compared to the first group of pulsers. The third group of pulsers is known as siren-type pulsers with a continuously rotating rotor in one direction. Pulsers of this group provide accurate control over the rotor position in time, but require a high level of power consumption typically from powerful source of energy, such as a turbo alternator, resulting in a significant increase of the cost and maintenance of the equipment. Also, the siren pulsers are configured to use only data transmission methods based on carrier frequency modulation techniques. All three groups of pulsers have a complex design, including the use of multiple bearing systems, and they are characterized by high manufacturing and maintenance costs.

Thus, a need exists for a modulator assembly with low energy consumption, a simple design, and low manufacturing and maintenance costs. A need also exists for a modulator assembly capable of providing high data transmission rates by using different modulations and combinatorial schemes, as well as generating sequences of single pulses with opening/closing times of 50 ms or less. These and other needs are addressed by an exemplary modulator assembly discussed herein in which the strong external drilling fluid flow load is decoupled from downhole gearbox and motor, avoiding the use of complex design with multiple bearing systems and allowing utilization of drilling fluid pressure to reduce its energy consumption.

SUMMARY

This invention relates to a hydrostatically balanced modulator assembly and associated methods for generating pressure fluctuations in drilling fluid, which are used for downhole communication in oil and gas wells. The system is designed to enable reliable, high-speed signal transmission under a wide range of drilling conditions, including deep and high-pressure wells.

A hydrostatically compensated modulator assembly and method for generating pressure wave fluctuations in drilling fluid flow are disclosed, enabling advanced downhole telemetry. The assembly includes a housing, fluid passages, a hydraulic oil-filled chamber, and reciprocating members operatively connected to obstruction portions that modulate flow by transmitting lateral movement while allowing axial freedom. Kinetic energy from drilling fluid is diverted primarily to the chamber body, reducing stress on moving actuator components. A piston is positioned at the lower chamber portion with its base directly exposed to drilling fluid, maintaining approximate hydrostatic balance between oil pressure in the chamber and drilling fluid pressure outside, allowing movement with relatively small applied force and minimizing actuator loads. A motor and gearbox-driven actuator enables high-speed signal generation. A programmable controller provides adaptive signal encoding, telemetry management, and direct interface with surface equipment via downlinking, allowing real-time adjustment of encoding schemes and operational parameters. The invention advances durability, reliability, energy efficiency, and data rates for mud pulse telemetry.

The assembly comprises a housing containing a chamber filled with hydraulic oil. A piston is movably disposed at a lower portion of the chamber along the modulator axis, with its base exposed to drilling fluid pressure to achieve hydrostatic balance. A cylinder, oriented perpendicular to the wellbore axis, has a first end positioned inside the chamber and a second end extending outside a side wall of the chamber. A fluid flow restrictor member, such as a restrictor plate, is mechanically linked to the cylinder via a connector (e.g., a rod), and is positioned to selectively with high precision obstruct a passage in the housing through which drilling fluid flows. The fluid passage may be located in a gap between the chamber and housing or through an elongated slot in a supporting plate in another design of the modulator assembly. The restrictor plate is designed to move with low friction over a flat surface, with a small gap (e.g., about 0.05-0.1 mm) to prevent fluid bypass and maintain signal integrity. The restrictor member is configured for independent axial movement relative to the cylinder resulting the kinetic energy from the drilling fluid acting on the restrictor is transmitted directly to the chamber body avoiding the impact to the actuator and gearbox, thus eliminating the need for complex bearing systems and reducing mechanical stress on moving parts.

A linear actuator, including a mechanical conversion mechanism (such as a cylinder with an inclined groove), is coupled to the piston and converts oscillating rotational motion of a motor into precise linear reciprocation. The actuator assembly may be filled with lubricant and is designed for efficient force transmission, with the motor and gearbox selected to provide sufficient power for high-frequency signal generation to overcome external pressures and frictional forces encountered during deep drilling operations.

The system includes a controller for precise operation, capable of running the motor in an energy regeneration mode during acceleration and deceleration phases, with regenerated energy stored in a capacitor bank for later use. The controller also enables dynamic adjustment of signal for the selected encoding schemes—such as frequency modulation, combinatorial frequency alphabets, or single-pulse sequences—based on real-time downhole and surface conditions. If signal amplitude is insufficient, the system can automatically increase drilling fluid flow or switch encoding scheme parameters.

Methods are provided for: installing and operating the modulator assembly in the wellbore; calculating optimal travel distances for the piston and cylinders, gear ratios, and required hydraulic pressures in the chamber cavity filled with hydraulic oil to ensure reliable operation at any well depth and fluid flow rate; adjusting the assembly to compensate for thermal expansion/contraction of hydraulic oil; selecting the optimal width of the fluid passage for efficient signal generation; and encoding and transmitting information to the surface with high accuracy and adaptability.

In accordance with embodiments of the present disclosure, an exemplary hydrostatically compensated modulator assembly for generating pressure wave fluctuations in drilling fluid flow is provided. The hydrostatically compensated modulator assembly includes a housing having two or more drilling fluid flow passages. Each passage of the two or more drilling fluid flow passages is configured as either (a) a gap between an inner surface of the housing and an outer surface of a chamber within the housing, or (b) an elongated slot in a supporting plate fastened to the chamber within the housing. The hydrostatically compensated modulator assembly includes the chamber within the housing filled with hydraulic oil. The hydrostatically compensated modulator assembly includes two or more reciprocating members disposed substantially perpendicular to a wellbore axis and at least partially within the chamber. Each reciprocating member of the two or more reciprocating members is operatively associated with a respective drilling fluid flow passage and operatively connected to an obstruction portion that is positioned to partially or completely obstruct said drilling fluid flow passage during operation. Said connection transmits lateral movement from the reciprocating member to the obstruction portion for obstruction of the passage while permitting axial freedom of relative motion, such that kinetic energy resulting from drilling fluid flow acting on the obstruction portion is diverted primarily to a fixed surface of a chamber body of the chamber. The hydrostatically compensated modulator assembly includes a piston located at a lower portion of the chamber. A base of the piston is directly exposed to the drilling fluid, so that pressure exerted by the drilling fluid is transmitted to the hydraulic oil within the chamber, thereby maintaining an approximate hydrostatic balance between oil pressure inside the chamber and a drilling fluid pressure outside the chamber. The hydrostatically compensated modulator assembly includes a motor and a gearbox assembly operatively coupled to a linear actuator for converting rotary motion into axial displacement of the piston. A power rating of the motor and a gearbox ratio are selected so that the linear actuator is capable of moving the piston by a predetermined distance within either (a) a half-period of a highest frequency utilized for pressure signal encoding, or (b) a minimum time required to fully open or close the respective drilling fluid flow passage for individual pressure pulse generation. The hydrostatically compensated modulator assembly includes a controller programmed to regulate movement of the two or more reciprocating members, controlling obstruction of the drilling fluid flow passages to produce pressure fluctuation waves. The controller is configured to select and implement a signal encoding scheme chosen from at least one of: (i) alphabet frequencies combinatorial encoding, (ii) carrier frequency modulation, or (iii) single pulse sequence generation, and further configured to change the signal encoding scheme or adjust parameters of the signal encoding scheme in response to downlinking instructions received from a surface. The controller is capable of operating the hydrostatically compensated modulator assembly to generate pressure signals sufficient for high-speed data transmission.

In some embodiments, each reciprocating member of the two or more reciprocating members include a cylinder positioned substantially perpendicular to the wellbore axis, and the obstruction portion includes a restrictor plate operatively connected to the cylinder.

In some embodiments, the restrictor plate is structured and configured to enable partial or complete obstruction of the respective drilling fluid flow passage during operation, the operative connection between the cylinder and restrictor plate transmits lateral movement while permitting axial freedom of relative motion, the restrictor plate moves with respect to a fixed chamber surface, and a gap of 0.05-0.1 mm is maintained to prevent fluid bypass and ensure integrity of pressure signal generation.

In some embodiments, kinetic energy from drilling fluid flow acting on the restrictor plate is diverted primarily to the fixed chamber surface. The motor and gearbox assembly are housed in a lubricant-filled housing and coupled to a mechanical conversion mechanism for converting rotary motion into linear movement along the wellbore axis. The mechanical conversion mechanism includes a cylinder with an inclined groove of angle $\alpha$, enabling the output shaft of the piston to move exclusively in the axial direction as the cylinder oscillates for matching amplitude and direction of reciprocation.

In some embodiments, the controller is configured to operate the motor in an energy regeneration mode during at least one of (a) deceleration as the two or more reciprocating members move out of the chamber, or (b) acceleration as the two or more reciprocating members move into the chamber, with regenerated energy stored in a capacitor bank for subsequent use during signal generation. Energy for actuator operation and signal generation is supplemented by regenerated power from fluid-induced movements.

In some embodiments, the hydrostatically compensated modulator assembly is configured to calculate maximum travel distances of the piston and the two or more reciprocating members according to $Sp \times Lp = M \times Scyl \times Lcyl$, where Sp is a cross-sectional area of the piston, Lp is a travel distance of the piston, Scyl is a cross-sectional area of each cylinder, Lcyl is a travel distance of each cylinder, and M is a number of reciprocating members.

In some embodiments, the power rating of the motor and the gearbox ratio are selected based on operational conditions or telemetry quality criteria, and the motor and the gearbox assembly are configured to generate a maximum pressure, Pmax, in the hydraulic oil chamber sufficient to overcome expected external pressure and frictional losses. Pmax is calculated as $Pmax = Pcomp_max + Pflow_diff_max + Psignal_max + Pfrictions$, where Pcomp_max is a maximum compensatory pressure, Pflow_diff_max is a maximum flow-induced differential, Psignal_max is a maximum signal pressure amplitude, and Pfrictions is a pressure needed to overcome frictional losses; and wherein Pcomp_max is calculated as $Pcomp_max = (TVD \times \rho \times A)/1000$, where TVD is true vertical depth, p is a density of the drilling fluid, and A is a cross-sectional area of the piston.

In some embodiments, at least one of (i) the obstruction portion includes a substantially flat surface perpendicular to the direction of drilling fluid flow, configured to maximize efficiency of signal pulse generation, and each of the two or more reciprocating members, the obstruction portion, and their operative connection are made from wear-resistant material selected to ensure long-term durability in drilling environment, or (ii) the chamber is dimensioned and the piston is sized such that hydrostatic pressure balance is maintained for a range of drilling fluid densities and depths encountered during operation.

In some embodiments, the controller is programmed to evaluate telemetry signal quality and, if required, automatically change the encoding scheme or adjust its parameters responsive to downlinking instructions or real-time telemetry performance, and the controller is configured to store a preselected encoding scheme and switch to alternative encoding if adverse transmission conditions are detected during operation.

In some embodiments, at least one of (i) the obstruction portions are configured to allow sequential or simultaneous actuation of multiple passages, thereby supporting multiplexed pressure signaling for improved data rates, (ii) the controller implements error detection and correction algorithms for pressure signal transmission based on feedback from received telemetry data, or (iii) the hydrostatically compensated modulator assembly comprises secondary seals and guide elements positioned to further prevent unintentional bypass of drilling fluid around the obstruction portions during signal generation.

In accordance with embodiments of the present disclosure, an exemplary method for generating pressure wave fluctuations in drilling fluid flow is provided. The method includes installing a hydrostatically compensated modulator assembly with a housing having two or more drilling fluid flow passages, each passage of the two or more drilling fluid flow passages configured as either (a) a gap between an inner surface of the housing and an outer surface of a chamber, or (b) an elongated slot in a supporting plate fastened to the chamber within the housing. The method includes filling the chamber within the housing with hydraulic oil. The method includes disposing two or more reciprocating members substantially perpendicular to a wellbore axis and at least partially within the chamber, each reciprocating member of the two or more reciprocating members operatively associated with a respective drilling fluid flow passage and operatively connecting to an obstruction portion positioned to partially or completely obstruct the drilling fluid flow passage during operation. Said connection transmits lateral movement from the reciprocating member to the obstruction portion for obstruction of the passage while permitting axial freedom of relative motion, such that kinetic energy from drilling fluid flow acting on the obstruction portion is diverted primarily to a fixed surface of a chamber body. The method includes exposing a piston at a lower portion of the chamber, a base of the piston being directly exposed to drilling fluid, so that pressure exerted by the drilling fluid is transmitted to the hydraulic oil within the chamber, thereby maintaining an approximate hydrostatic balance between oil pressure inside the chamber and a drilling fluid pressure outside the chamber. The method includes operating a motor and a gearbox assembly coupled to a linear actuator to move the piston by converting rotary motion into axial displacement. A power rating of the motor and a gearbox ratio are selected so that the linear actuator moves the piston by a predetermined distance within either (a) a half-period of a highest frequency utilized for pressure signal encoding, or (b) a minimum time required to fully open or close the respective drilling fluid flow passage for pressure pulse generation. The method includes regulating movement of the two or more reciprocating members using a controller, so that obstruction of the drilling fluid flow passages generates pressure fluctuation waves in the drilling fluid. The controller selects and implements a signal encoding scheme chosen from at least one of: (i) alphabet frequencies combinatorial encoding, (ii) carrier frequency modulation, or (iii) single pulse sequence generation, and further changes the signal encoding scheme or parameters of the signal encoding scheme in response to downlinking instructions received from a surface. The controller is capable of operating the hydrostatically compensated modulator assembly to generate pressure signals sufficient for high-speed data transmission.

In some embodiments, each reciprocating member of the two or more reciprocating members includes a cylinder positioned substantially perpendicular to the wellbore axis, and the obstruction portion includes a restrictor plate operatively connected to the cylinder.

In some embodiments, the restrictor plate is structured and configured to enable partial or complete obstruction of the respective drilling fluid flow passage during operation, the operative connection transmits lateral movement while permitting axial freedom, and the restrictor plate moves with respect to a fixed chamber surface, maintaining a gap of 0.05-0.1 mm to prevent fluid bypass and ensure integrity of pressure signal generation.

In some embodiments, kinetic energy from drilling fluid flow acting on the restrictor plate is diverted primarily to the fixed chamber surface, and the motor and gearbox assembly are housed in a lubricant-filled housing and coupled to a mechanical conversion mechanism for converting rotary motion into linear movement along the wellbore axis. The mechanical conversion mechanism includes a cylinder with an inclined groove of angle $\alpha$, enabling the output shaft of the piston to move exclusively in the axial direction as the cylinder oscillates for matching amplitude and direction of reciprocation.

In some embodiments, the method includes operating the controller to provide energy regeneration during at least one of (a) deceleration of the two or more reciprocating members as they move out of the chamber, or (b) acceleration of the two or more reciprocating members as they move into the chamber, with regenerated energy stored in a capacitor bank for subsequent use during signal generation, and energy for actuator operation and signal generation is supplemented by regenerated power from fluid-induced movements.

In some embodiments, the method includes calculating maximum travel distances of the piston and the two or more reciprocating members according to $Sp \times Lp = M \times Scyl \times Lcyl$, where Sp is a cross-sectional area of the piston, Lp is a travel distance of the piston, Scyl is a cross-sectional area of each cylinder, Lcyl is a travel distance of each cylinder, and M is a number of reciprocating members.

In some embodiments, the power rating of the motor and the gearbox ratio are selected based on operational conditions or telemetry quality, and the motor and the gearbox assembly are operated to generate a maximum pressure, Pmax, in the hydraulic oil chamber sufficient to overcome expected external pressure and frictional losses. Pmax is calculated as $Pmax = Pcomp_max + Pflow_diff_max + Psignal_max + Pfrictions$, where Pcomp_max is a maximum compensatory pressure, Pflow_diff_max is a maximum flow-induced differential, Psignal_max is a maximum signal pressure amplitude, and Pfrictions is a pressure needed to overcome frictional losses; and Pcomp_max is calculated as $Pcomp_max = (TVD \times \rho \times A)/1000$, where TVD is true vertical depth, $\rho$ is a density of the drilling fluid, and A is a cross-sectional area of the piston.

In some embodiments, at least one of (i) the obstruction portion includes a substantially flat surface perpendicular to the direction of drilling fluid flow, configured to maximize efficiency of signal pulse generation, and wherein each of the two or more reciprocating members, the obstruction portion, and operative connection are made from wear-resistant material selected to ensure long-term durability in the drilling environment, or (ii) the chamber is dimensioned and the piston is sized such that hydrostatic pressure balance is maintained for a range of drilling fluid densities and depths encountered during operation.

In some embodiments, the method includes programming the controller to evaluate telemetry signal quality and, if required, automatically change the encoding scheme or adjust its parameters in response to downlinking instructions or real-time telemetry performance, and including storing a preselected encoding scheme in the controller and switching to an alternative encoding if adverse transmission conditions are detected.

In some embodiments, at least one of (i) the obstruction portions are configured to allow sequential or simultaneous actuation of multiple passages to support multiplexed pressure signaling and improved data rates, (ii) the method includes implementing error detection and correction algorithms for pressure signal transmission based on feedback from received telemetry data, or (iii) the method includes providing secondary seals and guide elements to prevent bypass of drilling fluid around the obstruction portions during signal generation.

The hydrostatically balanced modulator assembly and methods described herein offer significant advantages over prior art systems, including improved reliability, reduced mechanical wear, enhanced energy efficiency, and the ability to transmit high-speed, high-integrity pressure signals under challenging drilling conditions.

Other objects and features will become apparent from the following detailed description considered in conjunction with the accompanying drawings. It is to be understood, however, that the drawings are designed as an illustration only and not as a definition of the limits of the invention.

BRIEF DESCRIPTION OF THE DRAWINGS

To assist those of skill in the art in making and using the disclosed hydrostatically balanced modulator assembly, reference is made to the accompanying figures, wherein.

DETAILED DESCRIPTION

Figure 1:
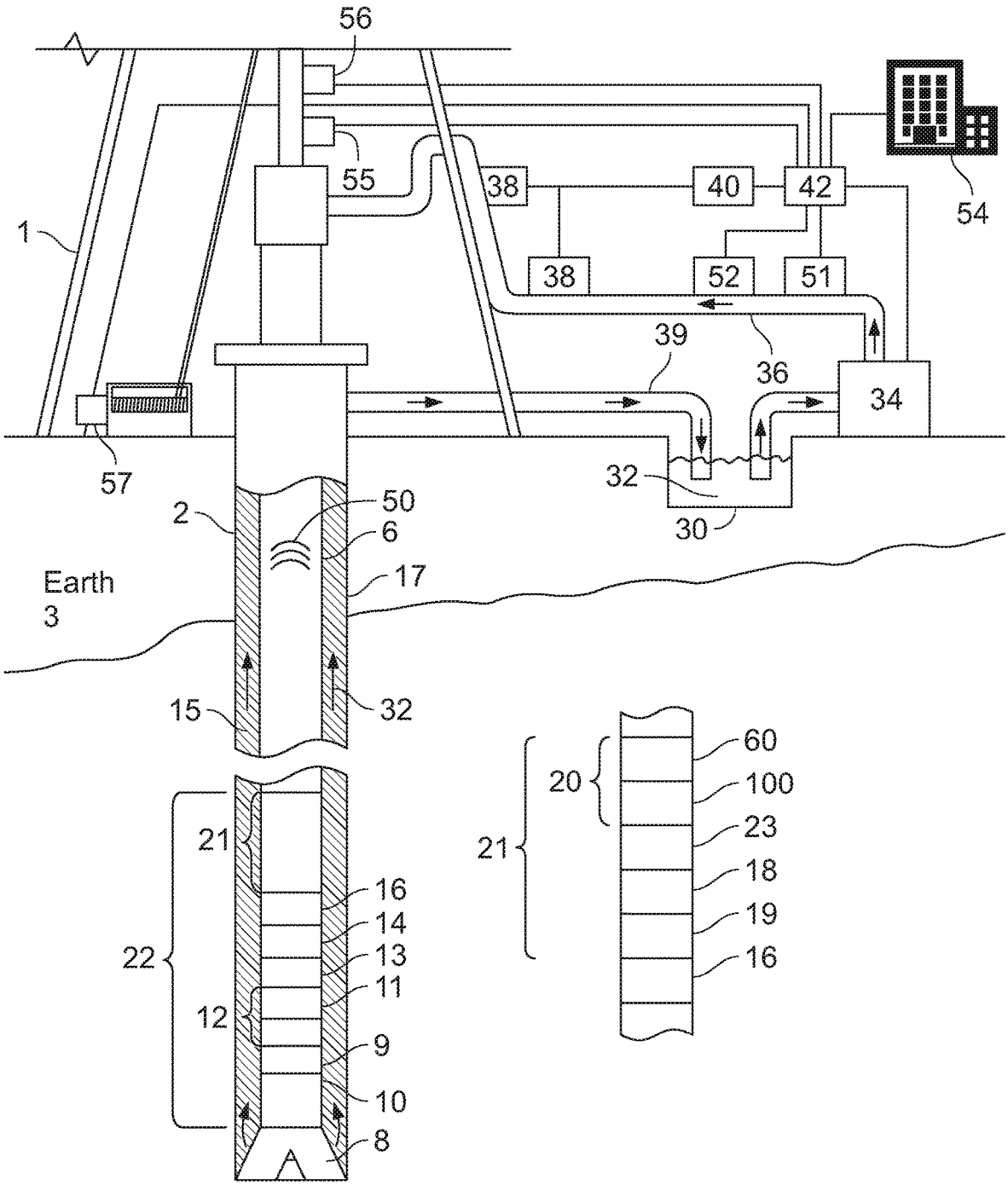
FIG. 1 is a diagrammatic view of a drilling rig with bottom hole assembly for directional drilling according to the present disclosure.

FIG. 1 is a diagrammatic view of a drilling rig (1) for implementation of an exemplary system for directional drilling using pressure balanced modulator assembly (21) and associated methods.

The drilling rig (1) can be engaged in drilling operations by using logging-while-drilling (LWD) acquisitions and downlinking for communication between the surface and the bottom borehole assembly (BHA). LWD operations typically include measurement-while drilling (MWD) operations, as well as additional measurements and drilling tools such as Rotary Steerable Systems (RSS). During operation, a wellbore hole (2) is drilled into the ground (3) through formation (5) by using the rotary drilling rig (1).

Drilling operation generally include the circulation of drilling fluid (32) (e.g., drilling mud) by pump (34) located at the surface through a mud line (36), into and through a drill string (6) down to the drill bit (8), and back to the surface through the annulus (15) between the drill string (6) and the borehole wall (17). The drilling fluid (32) exits the wellbore (2) via a return conduit (39), which routes the drilling fluid (32) back to one or more mud pits (30).

Downlinking is an important part of managing drilling operations including the control of RSS parameters. It is typically achieved in the present art by either periodically varying the flow rate of the drilling mud in the system or by periodically varying the rotation rate of drilling collars. Some methods utilize a combination of the above options. Using present art technology requires 3-7 or more minutes to send one downlinking instruction. There is a fast downlinking method and associated equipment described in U.S. Pat. No. 11,840,925 to Pogrebinsky, the contents of which are fully incorporated herein by reference in their entirety. As described in the '925 Patent, a modulator (51) has a rotational flap for generating harmonic pressure signals in flowing drilling fluid (32) by rotating a flap clockwise and counterclockwise inside the fluid mud line (36). The transducer (52) is used by the system to estimate an initial amplitude of the harmonic pressure waves in the drilling fluid (32) generated by modulator (51).

The BHA 22 at or near the distal end of the drill string (6) may include RSS (10), one or more centralizers (9), one or more sensor modules (12). In some embodiments, sensor modules (12) of the BHA (22) can include one or more flow recognition sensors (11), one more directional sensors, one or more formation evaluation sensors, combinations thereof, or the like. The BHA 22 includes at least one transducer (13), one or more sources of energy (14) (e.g., batteries and/or generators), and downhole electronics (including a controller (16)) in communication with the sensors (12) (including flow recognition sensor (11), transducer (13), and a modulator assembly (21)). The modulator assembly (21) can include a modulator (20), a gearbox (23), a motor (18), and motor driver (19) with electronic power board (e.g. printed circuit board (PCB)).

It should be understood that at least some (if not all) of the components of the downhole assembly can be communicatively connected to each other to allow for signals generated or received by the system to be collectively used for adjusting operation of the system. During operation in the uplink mode, the pressure fluctuations (50) propagate to the surface through the drilling fluid (32) and are detected at the surface by one or more transducers (38) which are connected to the fluid flow line (36). The analog/digital device (40) transmits a digital form of the pressure signals to a processing device or unit (42) (e.g., a computer or some other type of a data processing device). Processing device (42) operates in accordance with software programmed into the system to process and decode the signals received from the analog/digital device (40). The resulting LWD data can be further analyzed and processed to generate a display of various useful information. For example, the system can include a graphical user interface (GUI) capable of displaying data acquired and/or processed, which can assist with visually confirming proper operation of the system and/or adjusting operation of the system as needed based on operational requirements.

The present disclosure introduces a modulator assembly (21) which generates pressure waves by reciprocating restrictor(s) moving in the direction perpendicular to the direction of drilling fluid flow (32). In some embodiments a modulator (20) is able to generate a sequence of single pulses with short pulse width which are desirable for some known data transmission encoding/decoding methods. The preferred data transmission method for the present disclosure is the combinatorial frequencies alphabet method described in U.S. Pat. No. 11,459,877 to Pogrebinsky, the entire contents of which are incorporated herein by reference. A typical oscillated pulser in the present art restricts drilling fluid flow by moving a rotor in a direction perpendicular to the drilling flow direction, but it requires significant energy consumption due to the high value of rotor inertia and a need to overcome the impact of the kinetic energy of drilling fluid flow on the rotor. The design of the present disclosure eliminates a rotor, a magnetic coupling and bearing systems typical for known pulser designs resulting in significant reduction of energy consumption, faster closing/opening times, and allows for high precision of the restrictor positions in time. The proposed novel design reduces manufacturing and maintenance costs and refurbishing time. Various aspects of the hydraulically balanced modulator assembly (21) and an associated method are discussed and illustrated in more detail on FIGS. 2-18.

Figure 2:
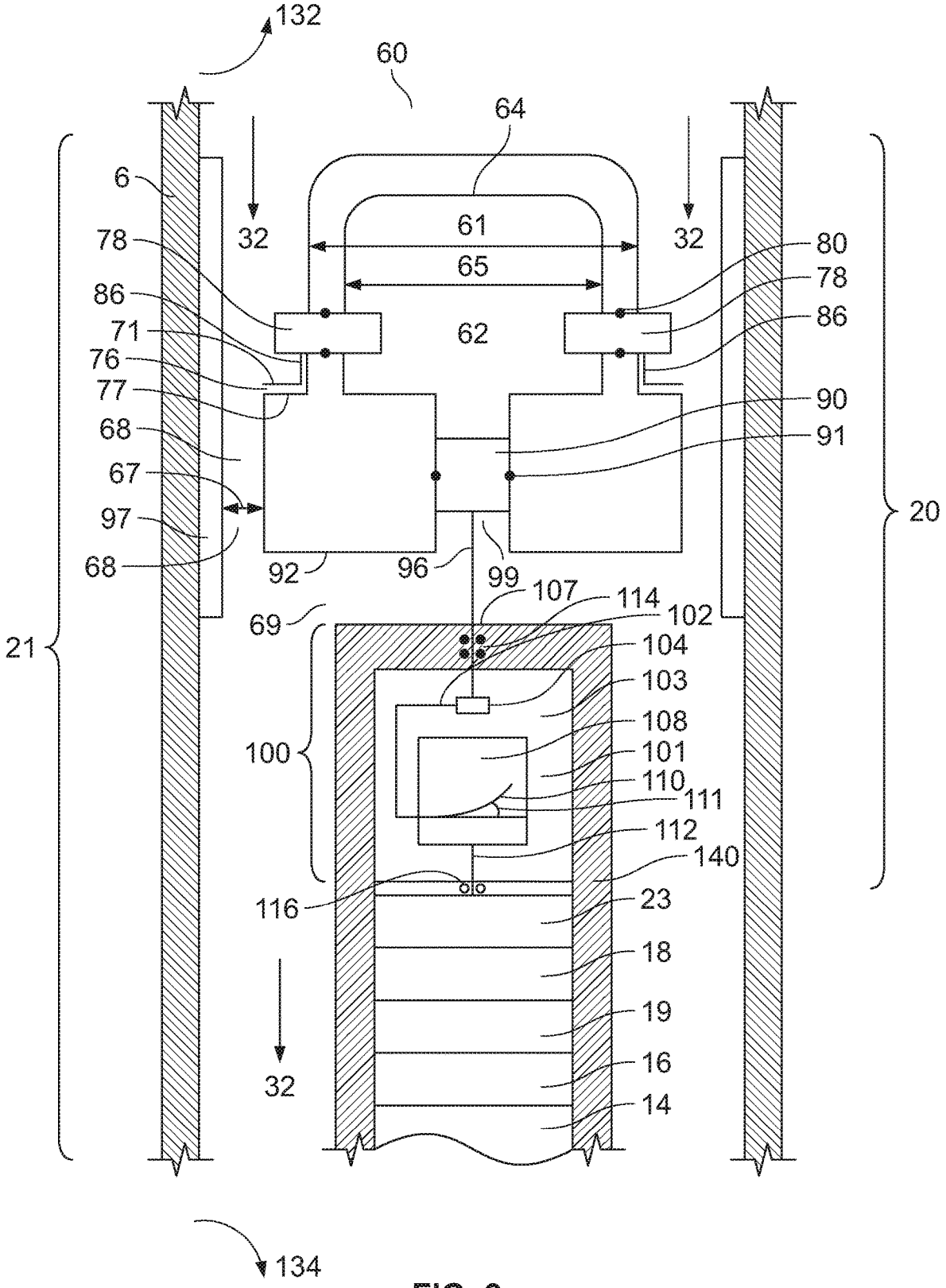
FIG. 2 is a schematic view of a reciprocating modulator assembly (21) for mud pulse telemetry.
Figure 7A:
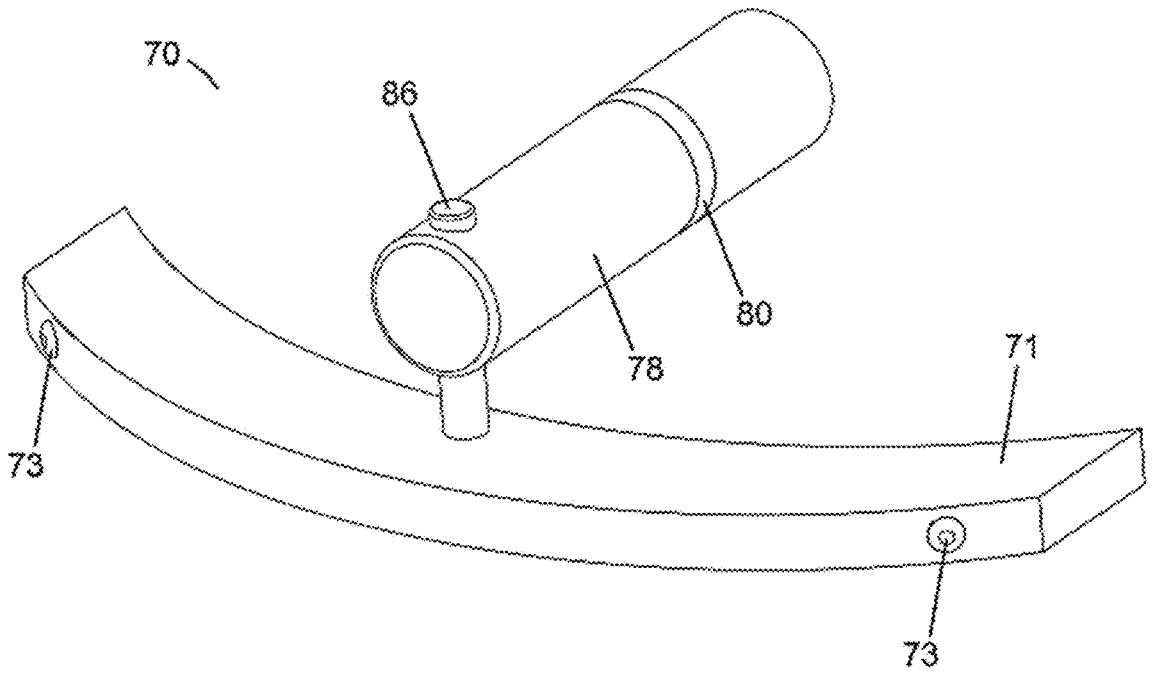
FIG. 7A is a three-dimensional (3D) side view of the reciprocated member (70) according to embodiments of the present disclosure.
Figure 7B:
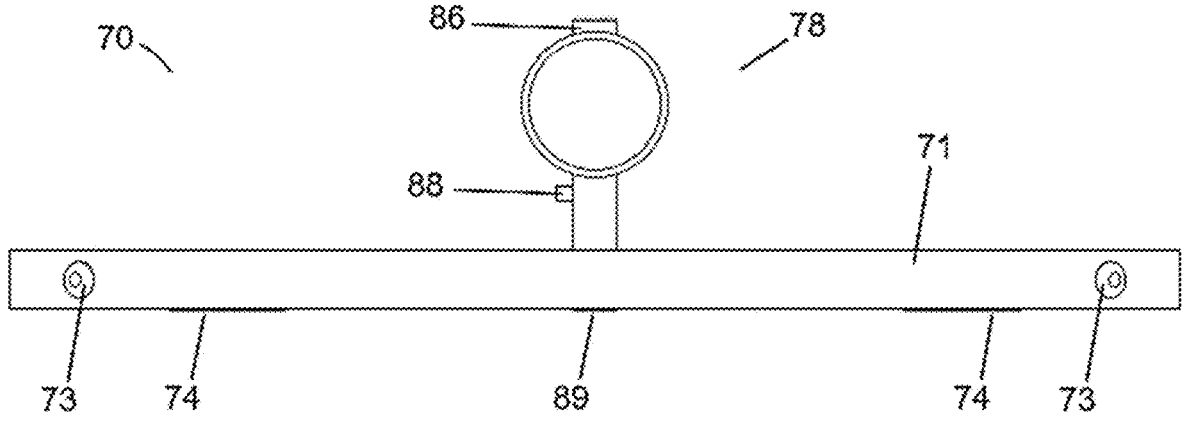
FIG. 7B is a side view of the reciprocated member (70) according to embodiments of the present disclosure.
Figure 7C:
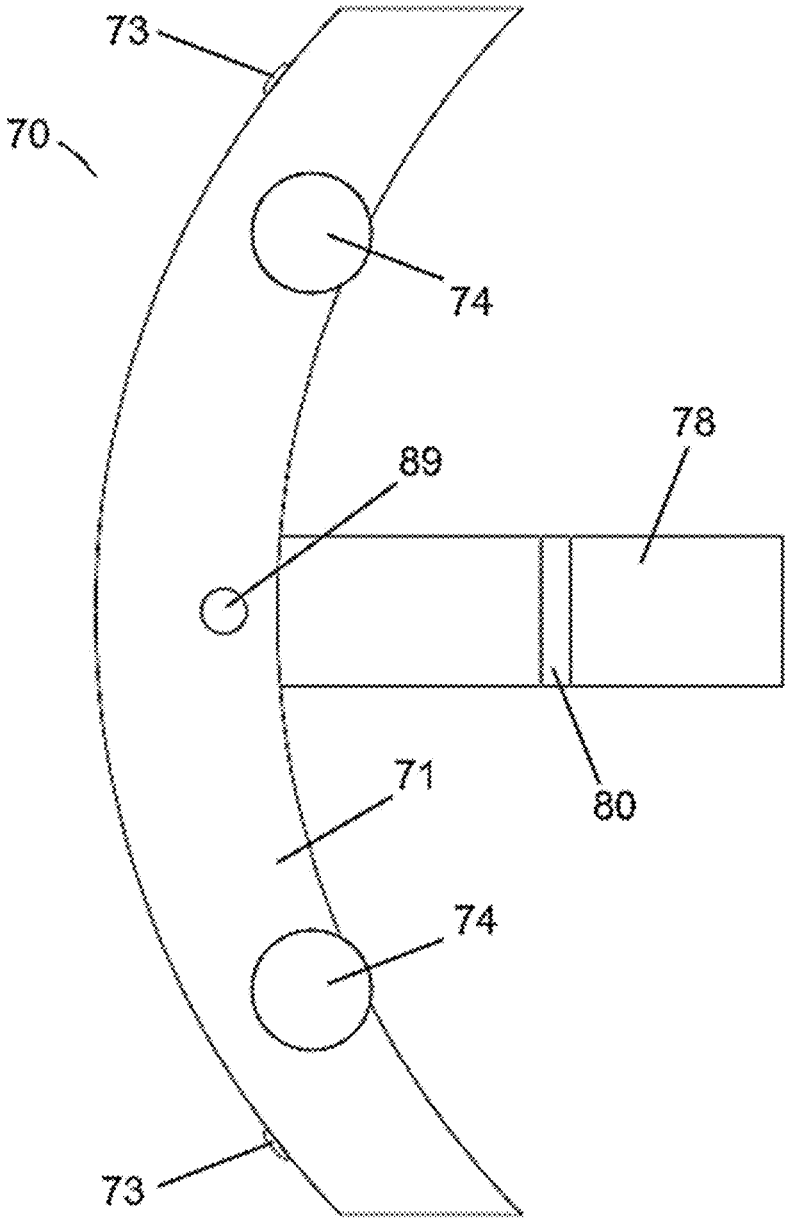
FIG. 7C is an upward view of the reciprocated member (70) according to embodiments of the present disclosure.

FIG. 2 is a schematic view of a reciprocating modulator assembly (21) for mud pulse telemetry for two embodiments or designs of the present disclosure. Position (132) shows the upward direction of the well, and position (134) shows the downward direction. The reciprocating modulator assembly (21) is located in an adapter (not shown) which is adapted to the drill collar (6). The first embodiment or design (FIG. 2) of the modulator (20) includes a body (97) that fits tightly against the inner surface of the drill collar (6), while the second embodiment or design (FIGS. 10 and 11) omits this body (97) and uses a different structural arrangement. In the upper part of the modulator assembly (21) is located a chamber (60) with a cavity (64) filled with hydraulic oil (62). In the lower part of the chamber (60) there is a cylindrical channel (99) which is connected to the cavity (64). A channel (99) accommodates a reciprocating piston (90) equipped with a fluid-impermeable seal (91), arranged to move axially within the channel. A space (69) is defined between a bottom surface (92) of an associated chamber (60) and the top surface (107) of a linear actuator (100), this space being filled with drilling fluid (32) during drilling operations. The reciprocation of piston (90) is actuated by a thin rod (96). Rod (96) is rigidly connected to the output shaft of piston (90) and is arranged in sliding engagement with an inclined groove (110) formed along the sidewall of a cylinder (108) disposed within the linear actuator mechanism (100). The linear actuator mechanism (100), including cylinder (108) and inclined groove (110), is housed within a protective casing (140). The piston (90) is configured such that its reciprocating movement modulates the pressure of hydraulic oil (62) contained in cavity the (64) within the chamber (60). This pressure variation results in lateral actuation of one or more cylinders (78). Each cylinder (78), fitted with fluid-impermeable seals (80), forms an integral part of a reciprocated member (70) (as illustrated in FIGS. 7A, 7B, and 7C). The reciprocated member (70) is designed to partially or totally obscuring drilling fluid flow (32) through a flow passage (68). As a consequence, the selective restrictions of the passage generates controlled pressure wave fluctuations (50) within the drilling fluid (32).

In one embodiment (design one), passage (68) has a width dimension equal to the radial distance (67) between the inner surface of the drill collar (6) and the outer surface of chamber (60). In an alternative embodiment (design two), represented in FIGS. 10-14, the passage (68) comprises an elongated rectangular slot or equivalent slot with smooth peripheral edges formed through a supporting plate (75). A restrictor plate (71), which constitutes another element of the reciprocated member (70), is mechanically coupled to cylinder (78) via a thin rod (86). The restrictor plate (71) is positioned such that it is capable of partially or completely impeding drilling fluid flow (32) through passage (68) during reciprocation. To ensure integrity of sealing during movement, the width of the chamber walls (i.e., the difference between the outside diameter (61) and inside diameter (65) of the chamber (60)) is configured to exceed distance (67) by an amount sufficient to prevent seals (80) from protruding beyond the chamber (60) walls throughout the full stroke of reciprocation.

In design one, the lower surface of reciprocated plate (71) is provided with inserts (74) (see FIG. 7C) that enable low-friction sliding engagement with an associated protrusion surface (77) of chamber (60). The clearance (76) between the inserts (74) and protrusion surface (77) is maintained within a range of about 0.05-0.1 mm to minimize fluid bypass and mechanical wear. In design two, sliding contact is maintained directly between reciprocated plate (71) and supporting plate (75) (see FIG. 13 and FIG. 14). The design ensures that outward extension of cylinders (78) from chamber (60) does not require overcoming the entire hydrostatic pressure of the drilling fluid (32). This is achieved by maintaining the hydraulic oil (62) pressure in the cavity (64) within the chamber (60) substantially equivalent to the hydrostatic pressure of drilling fluid (32) external to the chamber. Hydrostatic balance is established because both cylinder (78) and piston (90) are subjected to substantially equal hydrostatic force originating from the pressure equilibrium created by the intervening space (69), which is filled with drilling fluid (32).

Figure 15:
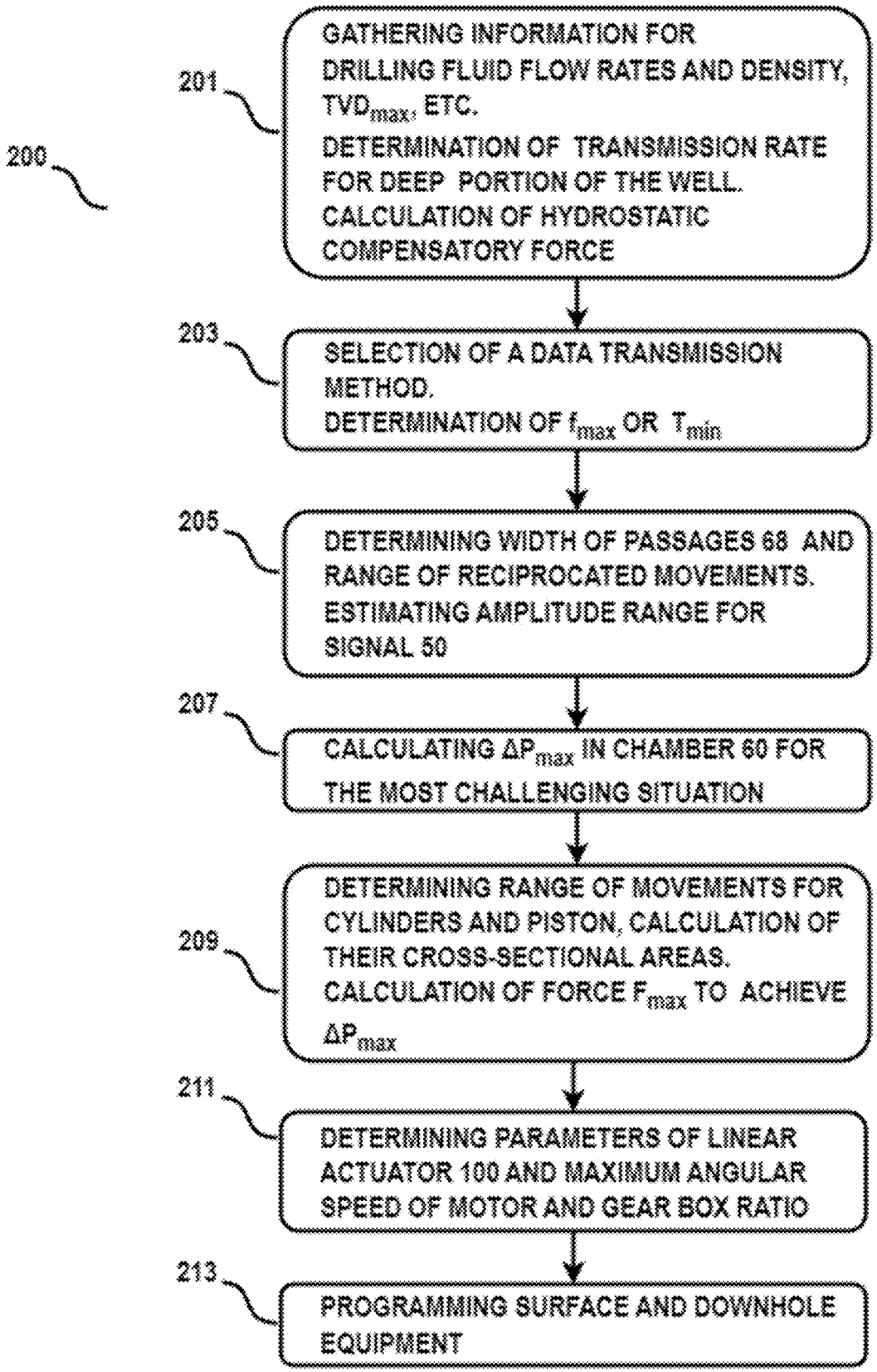
FIG. 15 is a flow chart and block diagram illustrating steps for planning and preparation stages to utilize the method of drilling using the modulator assembly according to embodiments of the present disclosure.

For precise hydraulic compensation within cavity (64), it is necessary to generate a compensatory pressure—using the piston (90)—such that the pressure of hydraulic oil (62) in cavity (64) equals the product of the hydrostatic drilling fluid pressure external to chamber (60) multiplied by the cross-sectional area of rod (96). The quantification and adjustment of this supplementary hydraulic pressure, necessary to ensure reliable actuation of cylinder (78), is further detailed in the planning and initialization stage 200 at step 201, as depicted in FIG. 15.

In contrast to conventional rotating pulser valves, the proposed designs of the modulator assembly (21) enable the kinetic energy of the drilling fluid flow (32) applied to the restrictor plate (71) to be transmitted directly downward to the protrusion surface (77) on the body of the chamber (60). These designs thereby effectively disengage the impact of the kinetic energy of the drilling fluid flow (32) on the reciprocating restrictor plate (71) from the cylinder (78). As a result, the coefficient of friction between the surface of the cylinder (78) and the inner surface of the hole in the side wall of the chamber (60) is minimized. Additionally, and unlike systems incorporating a rotational oscillating valve, the kinetic energy from the fluid is not transmitted to a gearbox or a motor. Consequently, the proposed solution allows for the simplification of modulator assembly (21) designs, for example design one and design two, by eliminating the need for multiple bearing systems. These improvements further provide the opportunity for reducing power consumption by utilizing the pressure of the drilling fluid (32) as an external energy source during approximately 50% of the signal generation cycle. In operation, the pressure of the drilling fluid (32) exerts a force on the external end surface of the cylinder (78). When the pressure of the drilling fluid (32) exceeds the pressure of the hydraulic oil (62) in the cavern (64), the cylinder (78) is displaced into the cavity (64), and vice versa. As an illustrative example, consider the cycle of closing and opening passage (68) to generate a single pressure pulse. At the initial moment, the reciprocating restrictor plate (71) begins to close passage (68), accelerating until reaching the midpoint of passage (68). During this acceleration phase, the rotational speed of motor (18) increases from zero to a selected value, for example, 8,000 revolutions per minute. The motor (18) consumes energy during this phase to overcome the specified external force.

During the subsequent phase, from the midpoint to the complete closure of passage (68), the motor (18) decelerates, reducing its speed from 8,000 revolutions per minute to a complete stop. This braking phase does not require the motor (18) to consume energy; rather, the external force enables the motor (18) to operate in a generator mode. The regenerated electrical energy is stored in a capacitor bank, and a controller may be configured to use this stored energy at an appropriate time to drive the motor (18), assisting in overcoming external forces and friction during selected periods of signal generation. During the opening of passage (68), changes in the rotational speed of the motor (18) follow a similar two-phase character, whereby the acceleration period is performed due to the impact of external force on the end of the cylinder (78) (with the motor operating in generator mode), and the braking phase requires the consumption of electrical energy by the motor (18).

The novel architecture of the modulator assembly (21) distinguishes it from conventional approaches by: mechanically isolating high fluid kinetic energy from drive components, resulting in low friction and wear; reducing mechanical complexity and failure points by omitting multiple bearing and gearbox systems; and improving overall energy efficiency by recovering energy during deceleration phases and utilizing external drilling fluid pressure as an auxiliary power source. These features provide significant advantages in downhole telemetry systems, including improved reliability, simplified construction, and reduced power requirements.

In the modulator assemblies (21), below the chamber (60) disposed the linear actuator mechanism (100), which transforms the rotational oscillations of the motor (18), or the motor (18) with a gearbox (23), into reciprocating movements of the piston (90). The present invention provides a novel design of the linear actuator mechanism (100), which converts the rotational motion of the motor (18) with gearbox (23) into linear movement of piston (90) by means of a cylinder (108) featuring an inclined groove (110). The angle (111) of the groove (110) is selected within a range of 10-20 degrees.

Figure 5:
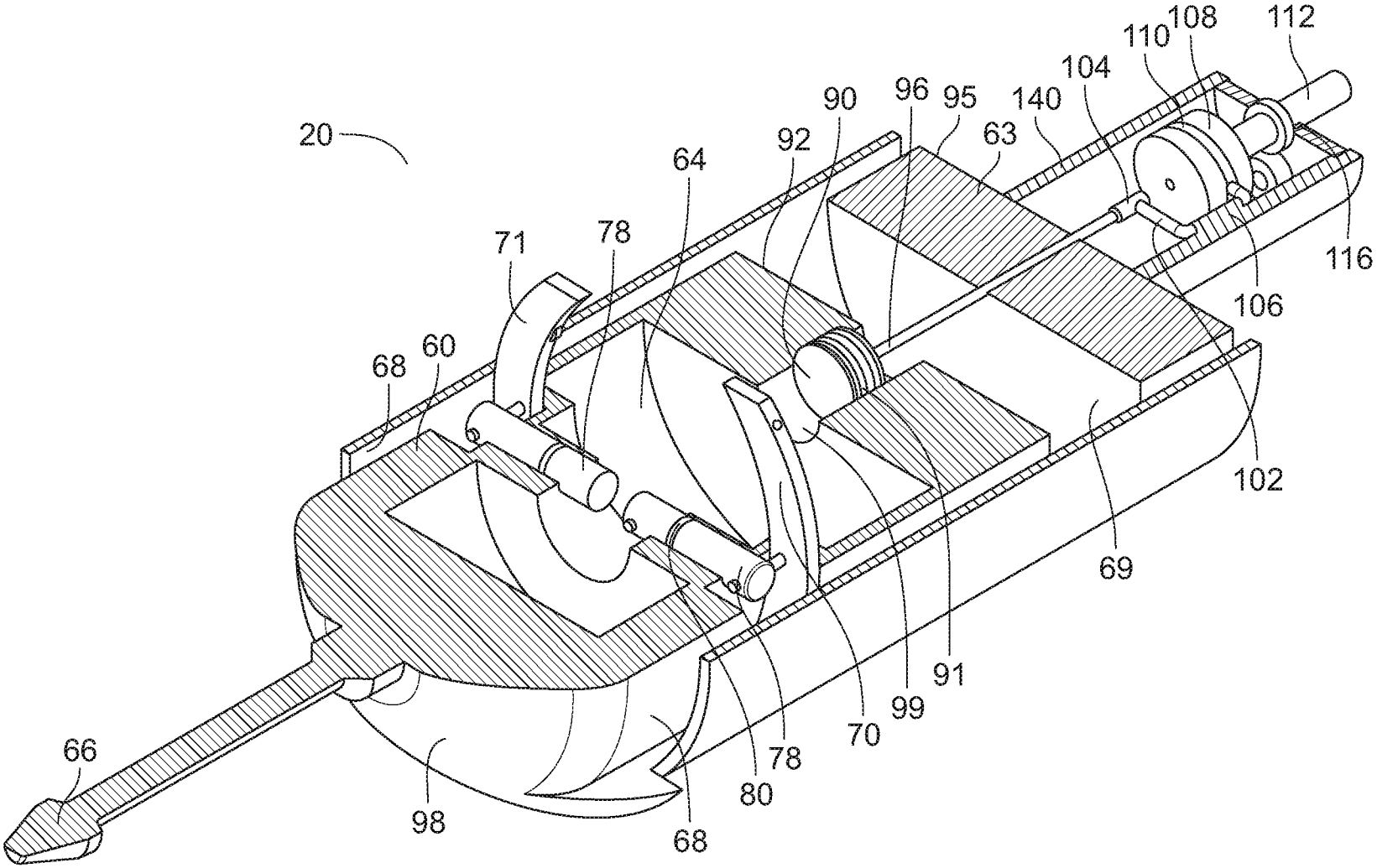
FIG. 5 is a schematic illustration of a modulator (20) and linear actuator mechanism (100) in the plane intersecting the drilling fluid flow passage (68) in accordance with embodiments of the present disclosure.
Figure 8:
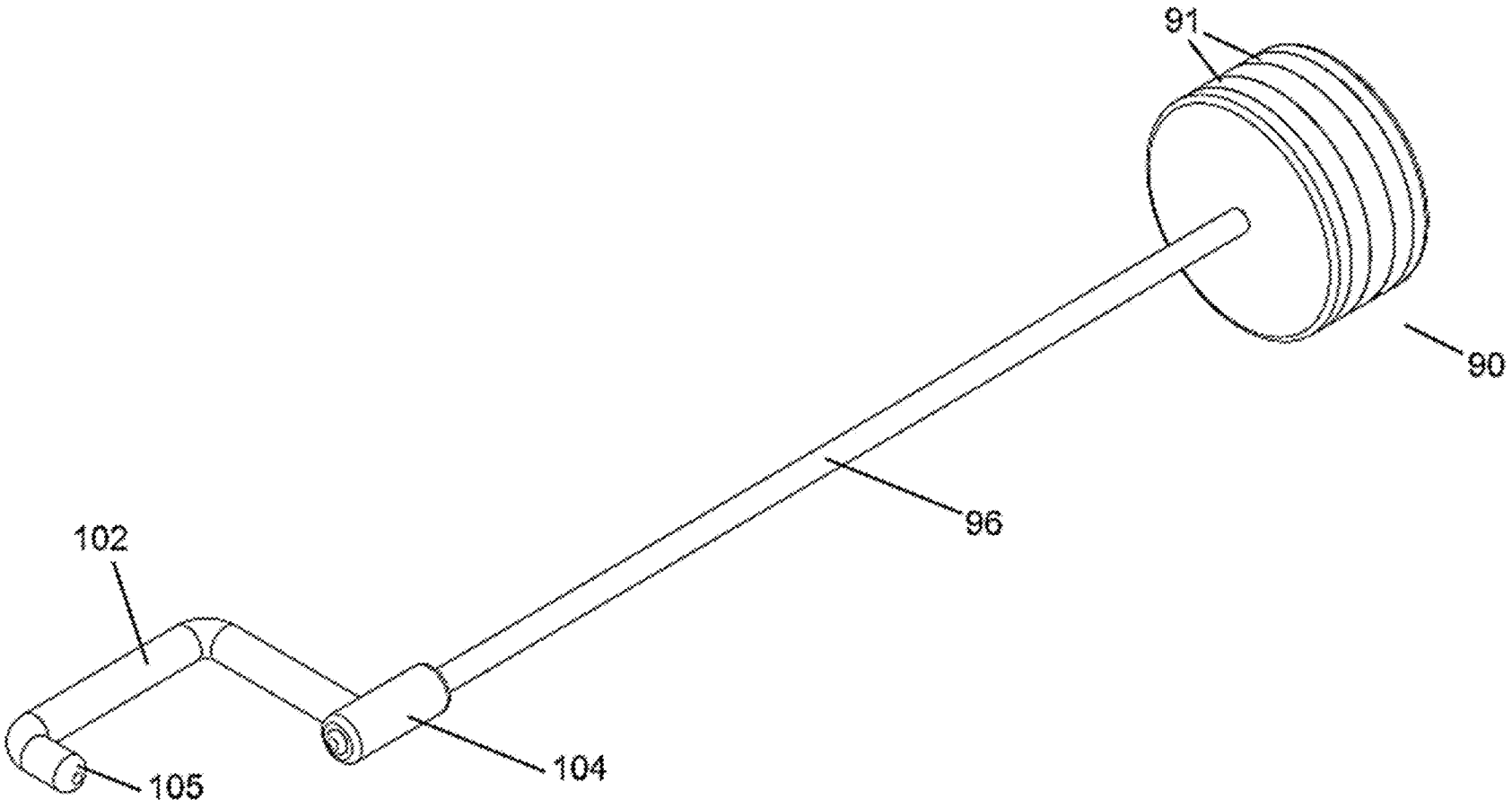
FIG. 8 is a three-dimensional (3D) view of the reciprocated piston (90) and shaft assembly (including positions (96; 104; 102 and 105)) connecting said piston with an oscillated cylinder (108) of the linear actuator mechanism (100) according to embodiments of the present disclosure.
Figure 9:
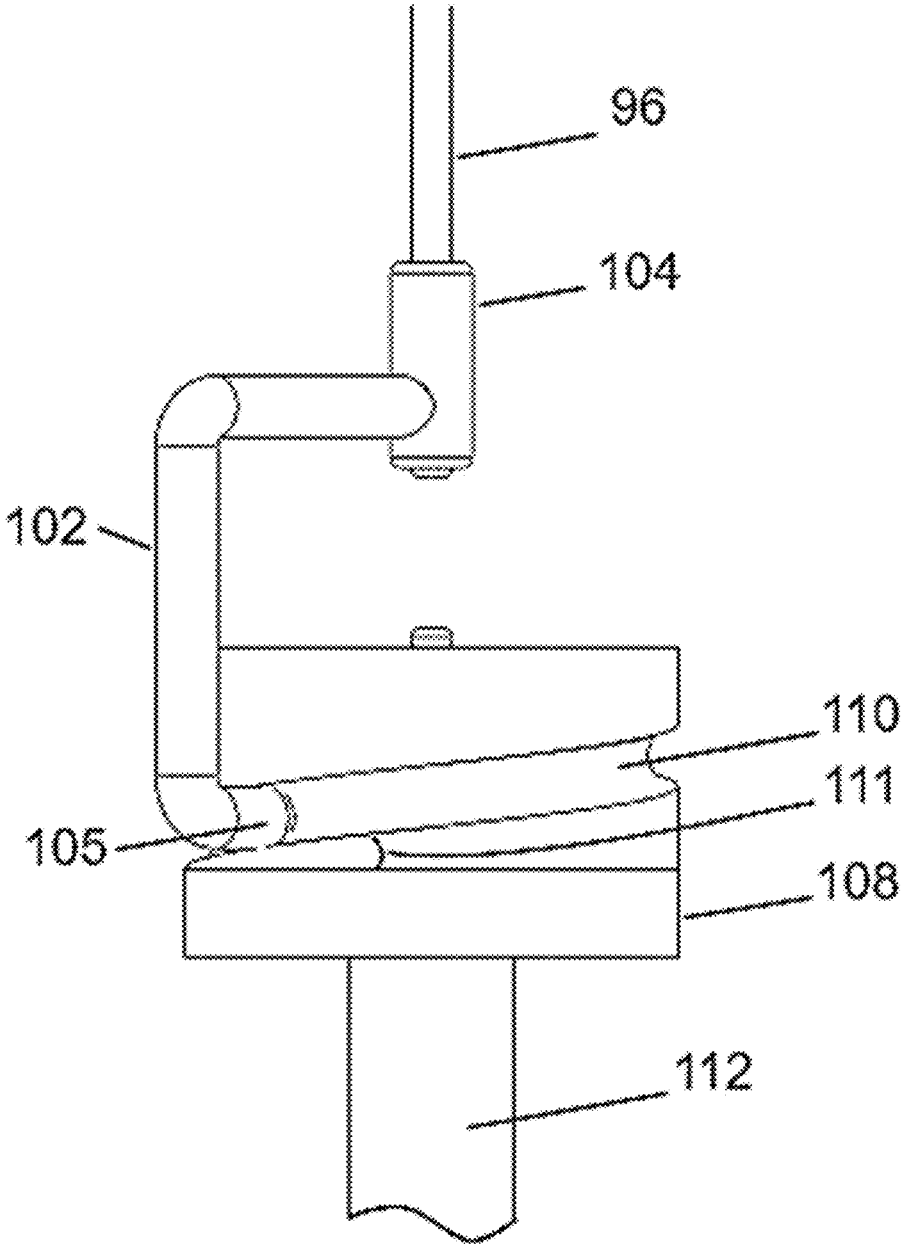
FIG. 9 is an illustration of a sliding contact between the oscillated cylinder (108) with inclined groove (110) and the downward tip (105) of the bypass elbow (102) according to embodiments of the present disclosure.

The linear actuator mechanism (100) includes a cavity (101) filled with lubricant (103), and an output shaft (112) extending from the gearbox (23) is connected to the cylinder (108). A bypass elbow (102) is attached to the groove (110) and forms a sliding contact such that, when the cylinder (108) oscillates, the tip (105) (as shown in FIGS. 8 and 9) of the bypass elbow (102) slides along the inner surface of the groove (110) with low friction. The bypass elbow (102) is constrained to only one degree of freedom, limited to movement in the direction parallel to the axis of the modulator assembly (21), which is ensured by a linear guide track (106) (as shown in FIG. 5). When the cylinder (108) rotates counterclockwise, the downward edge of the groove (110) moves the tip (105) of the bypass elbow (102) upward. Conversely, when the cylinder (108) rotates clockwise, the upward edge of the groove (110) moves the tip (105) downward. In this manner, oscillating rotation of the cylinder (108) is transformed into linear reciprocating motion of the bypass elbow (102) and rod (96), resulting in corresponding movement of piston (90). This movement, in turn, ensures actuation of the cylinder (78) and restrictor plate (71). The bypass elbow (102) is rigidly connected to the rod (96) via a fastening mechanism (104). Seals (114) and (116) ensure tightness of the cavity (101) filled with lubricant (103).

The proposed designs offer significant advantages by reducing the inertial mass of movable components, thereby increasing the maximum frequency of generated signals or reducing the time required to close or open the drilling fluid flow passages (68) during single pulse generation. When employing pulse position modulation, pulse width modulation, or their combinations, it becomes possible to decrease the time required for closing or opening the drilling fluid flow (32) passage (68), allowing the generation of sequences of single pulses with a width of 100 ms or less. In cases where carrier frequency modulation is used, or with the preferred method—such as the combinatorial frequency alphabet scheme described in U.S. Pat. No. 11,459,877 to Pogrebinsky—the proposed designs of the modulator assemblies (21) can generate harmonics in the range of about 0.25 to 12 Hz. The opportunity to implement various data encoding and transmission schemes is enabled by precise monitoring of the motor (18) angle and the corresponding position of the reciprocating restrictor plate (71) with high accuracy.

Figure 3:
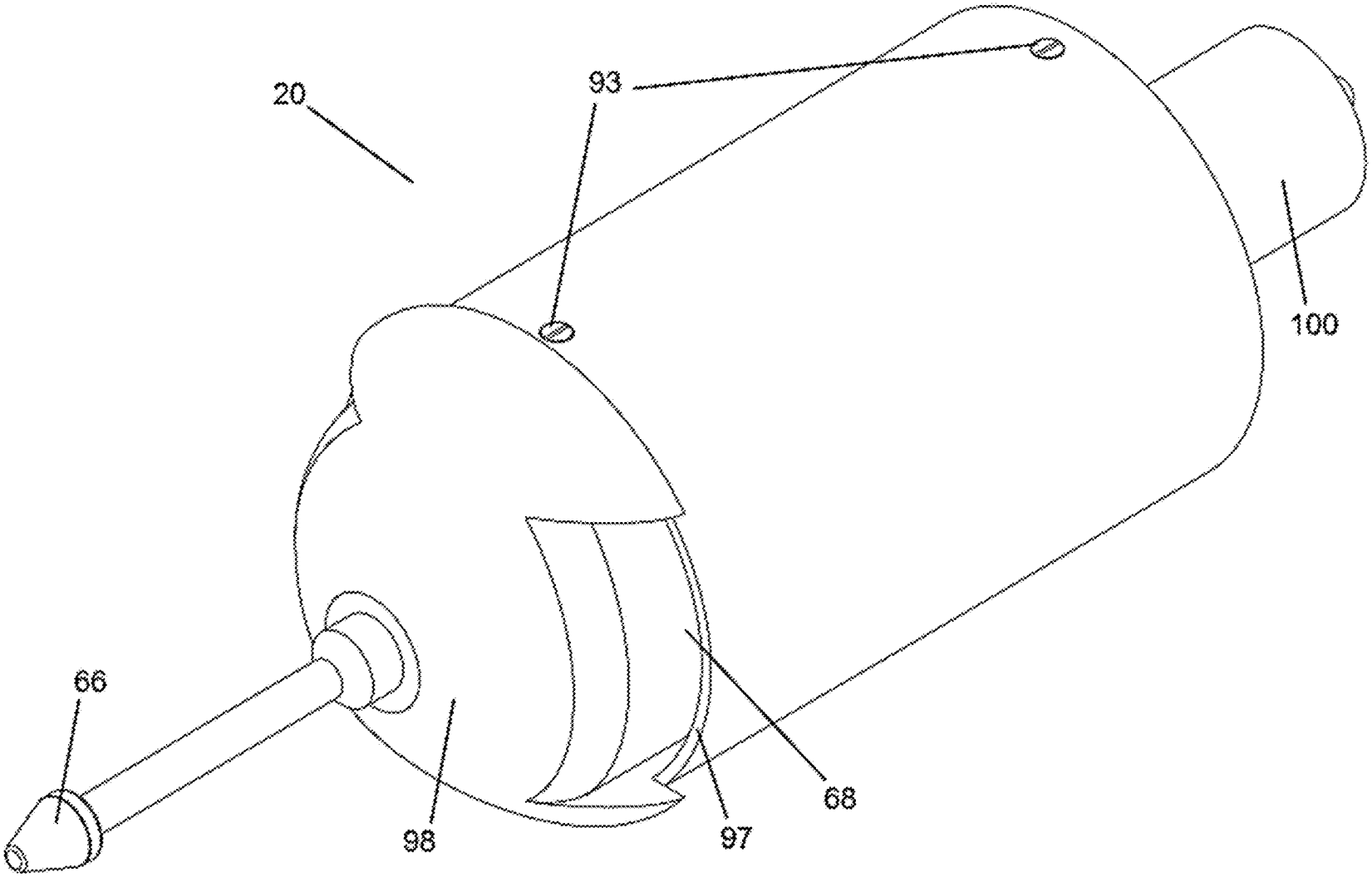
FIG. 3 is a three-dimensional (3D) side view in the downward well bore direction (134) in FIG. 2 of a modulator (20) according to embodiments of the present disclosure.

FIG. 3 presents a 3D view of the reciprocating modulator (20) oriented in the downward wellbore direction (134). The modulator (20) features an outer housing (97). The space between the inner surface of the outer housing (97) and the outer surface of the chamber (60) forms a passage (68) that allows drilling fluid (32) to flow through the modulator (20). The upper section (98) of the chamber (60)—also depicted in the cross-sections in FIG. 5 and FIG. 6—extends beyond the outer housing (97) sufficiently to ensure secure retention of the BHA within the adapter (not shown). For retrievable designs, the tip (66) is provided for extracting the modulator assembly (21) and other removable components of the BHA. The chamber (60) is secured to the outer housing (97) with bolts (93).

Figure 4:
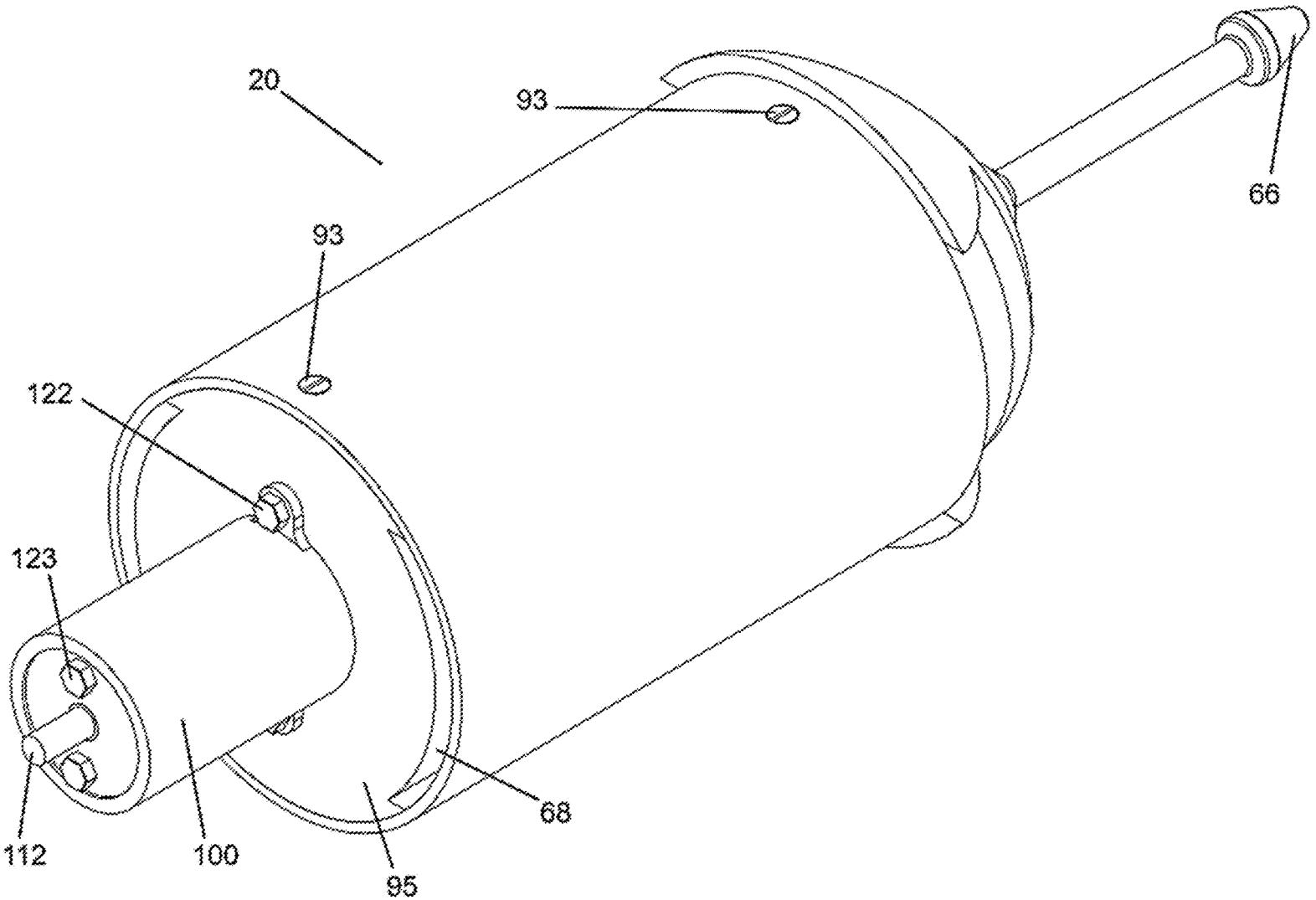
FIG. 4 is a three-dimensional (3D) side view in the upward well bore direction (132) in FIG. 2 of a modulator (20) according to embodiments of the present disclosure.

FIG. 4 shows a 3D side view of the reciprocating modulator (20) oriented in the upward wellbore direction (132). The linear actuator assembly (100) is attached to the bottom of the chamber (60) with bolts (122). The output shaft from the motor (18) or gearbox (23) is indicated at position (112). In design one of the present disclosure, the width of the outlet opening (68) is equal to the gap (67) (see FIG. 2) between the inner surface of the outer housing (97) and the outer surface of the chamber (60), specifically in the region below the protrusion surface (77) (see FIG. 2).

FIG. 5 provides a schematic illustration of the reciprocated modulator (20) and the linear actuator mechanism (100) in a partial isometric view, showing a cross-section through the center of the drilling fluid flow passages (68) as per design one of the present disclosure. FIG. 5 depicts the spatial relationship of the components of the reciprocated modulator (20) and linear actuator mechanism (100). Oscillating rotational movements from the motor (18) drive the gearbox (23), which reduces the rotational speed of the cylinder (78) according to the gearbox ratio (R). An inclined groove (110) is located on the side surface of this cylinder (108). The downward tip (105) (shown in FIG. 8) of the bypass elbow (102) enters the groove (110), enabling a low-friction sliding contact between the bypass elbow tip (105) and the groove surface during reciprocal cylinder (108) rotation. A linear guide track (106) restrains the position of the bypass elbow (102), allowing movement only along the axis of the modulator assembly (21). The cylinders (78) are oriented perpendicular to the chamber (60) side walls and are coaxially aligned with each other. The piston (90) moves reciprocally along the axis of the modulator (20) within a cylindrical channel (99). Depending on the hydraulic oil (62) pressure inside the chamber (60) cavity (64) and the pressure of the drilling fluid (32) outside the chamber (60), the cylinders (78) move towards areas of lower pressure. It should be noted that passage 68 is hydraulically connected to the space (69) between the bottom (92) of the chamber (60) and the upper surface of the lower portion (63) of the modulator. The groove angle (111) is selected based on the maximum motor rotational speed, the gear box ratio (R), and the desired maximum frequency of oscillations and/or the minimum required time for opening and closing the drilling fluid flow passage (68). The increase in force applied to the linear guide track (106) with larger groove angles (111) is also considered.

Figure 6:
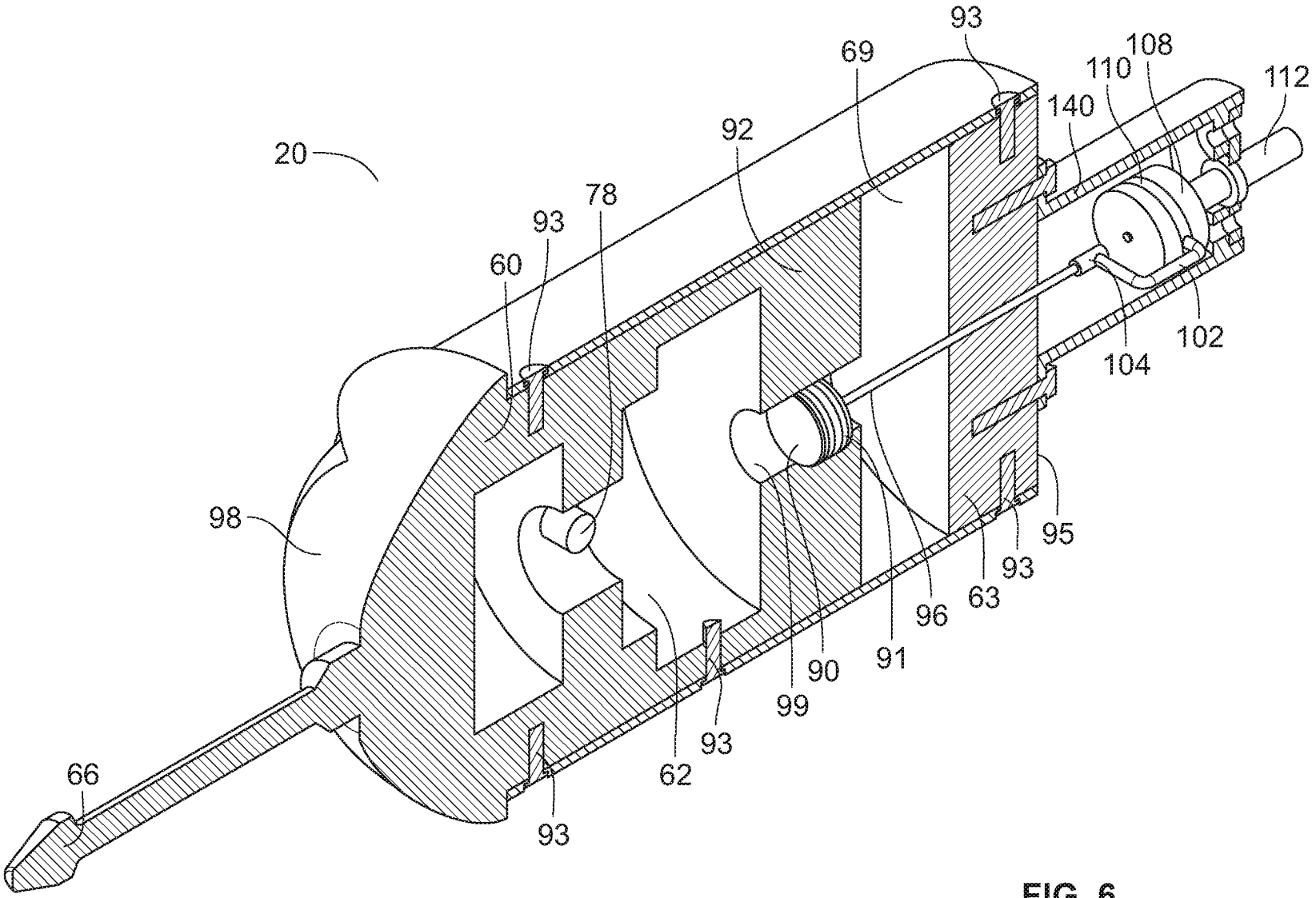
FIG. 6 is a schematic illustration of a modulator (20) and linear actuator mechanism (100) in a plane perpendicular to the cross-section shown on FIG. 5 in accordance with embodiments of the present disclosure.

FIG. 6 illustrates the reciprocating modulator (20) and linear actuator mechanism (100) in a partial isometric view, showing a cross-section of the modulator in the region where the drilling fluid flow passages (68) are absent, according to design one of the present invention. In this figure, the bypass elbow (102) is intentionally depicted out of its normal working position (see FIG. 5 for the correct placement) to better show its junction with the groove (110). The diameter of the cylinder (108) is maximized relative to the internal diameter of the protective case (140) of the linear actuator (100) and the diameter of the bypass elbow (102), in order to minimize the gap between the cylinder (108) and the bypass elbow (102). The groove (110) is designed with sufficient depth to ensure reliable axial contact within the modulator assembly (21), allowing for multiple reciprocal axial movements of the bypass elbow (102) and piston (90) during the clockwise and counterclockwise rotation of the cylinder (108) across its operational range. The groove depth is specified to be within the range of about 2 to 4 millimeters.

FIGS. 7A, 7B, and 7C illustrate the design of a restrictor member according to at least one embodiment of the present disclosure. FIG. 7A presents a 3D side view of the reciprocated member (70), which consists of a reciprocated plate (71), a sliding cylinder (78), and a rod (86). Both the outer end of the cylinder (78) and the reciprocated plate (71) are fitted with holes matching the diameter of the rod (86), allowing the rod to be inserted through them. The cylinder (78) and the reciprocated plate (71) move together with identical amplitude and direction. However, the proposed design provides one degree of freedom along the axis of the modulator (20), enabling the rod (86) and reciprocated plate (71) to move axially. This configuration channels the kinetic energy of the drilling fluid flow (32) directly onto the reciprocated plate (71) and subsequently down to the protrusion surface (77) on the chamber body (60). The impact of the drilling fluid's kinetic energy on the cylinder (78) is relatively minor and is proportional to the cylinder's diameter and its projected area in the downward wellbore direction. For example, with a cylinder (78) diameter of 8 mm, and an external extension of 6 mm in the fully open position and 12 mm in the closed position, the average impact area is 72 $mm^2$. Subtracting the cross-sectional area of the rod (86) (diameter 3 mm, area 7 $mm^2$), the effective impact area on the cylinder (78) becomes 65 $mm^2$. In comparison, with the reciprocated plate (71) having dimensions of 50 mm (length) and 12 mm (width), the kinetic impact area on the plate is 600 $mm^2$. Thus, this design reduces the adverse impact on the cylinder (78) by roughly an order of magnitude compared to a rigidly fastened reciprocating member (70). Furthermore, unlike conventional oscillating pulsers, the present design almost entirely eliminates the transmission of kinetic energy from the drilling fluid flow (32) to the gearbox (23) and motor (18). A sealing ring (80) is installed mid-length on the cylinder (78), and the chamber (60) wall thickness is dimensioned such that the sealing ring (80) remains within the chamber (60) during the entire reciprocating motion of the cylinder. The base of the reciprocated plate (71) is equipped with two or more guides (74), as shown in FIGS. 7B and 7C, to ensure low-friction sliding contact between the reciprocated plate (71) and the protrusion surface (77) (see FIG. 2) on the side wall of the chamber (60). Optionally, frontal limiters (73) may be installed at the front of the reciprocated plate (71) to guarantee a safety gap between the inner surface of the housing (97) and the front of the reciprocated plate (71).

FIG. 7B provides a side view of the reciprocated member (70) (design one). In this illustration, a locking mechanism (88) is shown installed on the rod (86) between the cylinder (78) and reciprocated plate (71), positioned near the cylinder to ensure a permanent connection between the rod (86) and reciprocated plate (71) perpendicular to the modulator axis (20). This locking mechanism (88) also secures the rod (86), preventing loss during drilling operations. The rod (86) features a rounded end (89), allowing it to slide with minimal friction along the protrusion surface (77).

FIG. 7C shows the reciprocated member (70) from the upward (132) direction (design one). The perimeter of the reciprocated plate (71) is shaped with a radius that matches the internal radius of the modulator's external housing (97). The frontal limiters (73) maintain a safety gap to prevent "water hammer" effects when generating single pulses. The figure also illustrates that certain guide inserts (74) extend beyond the inner edge of the reciprocated plate (71), forming a gap between the reciprocated plate (71) and the outer surface of the chamber (60). This arrangement ensures equalized drilling fluid (32) pressure on both sides of the reciprocated plate (71).

FIG. 8 presents a 3D view of the reciprocated piston (90) and its output shaft assembly, which connects the piston (90) to the oscillating cylinder (108) of the linear actuator mechanism (100). The piston (90) is equipped with sealing rings (91) to ensure proper sealing. A thin shaft (96) is securely attached to the base of the piston (90), while a fastening mechanism (104) firmly connects the rod (96) to the bypass elbow (102). The downward tip (105) of the bypass elbow (102) features a rounded shape. Notably, the bypass elbow (102) has a larger diameter than the shaft (96): the shaft is primarily subjected to compression and tension forces, whereas the downward tip (105) of the bypass elbow (102) is designed to withstand flexion and extension stresses.

FIG. 9 illustrates in 3D the sliding contact between the inclined groove (110) on the oscillating cylinder (108) and the downward tip (105) of the bypass elbow (102). The groove (110) is set at an inclination angle (111) relative to the base of the reciprocated cylinder (108). For reference, this angle is denoted as a degrees in subsequent calculations. Increasing the inclination angle (111) allows for higher maximum signal generation frequency or shorter opening/closing times for passages (68) during single pulse sequences. However, as this angle increases, the force component along the modulator assembly (21) axis decreases, while the perpendicular component increases, which leads to greater friction between the bypass elbow (102) and the linear guide track (106) (see FIG. 5). To mitigate undesirable lateral forces exerted by the bypass elbow (102) tip (105) on the linear guide track (106), it is necessary to limit the maximum value of angle $\alpha$. The selection of angle $\alpha$ is determined by multiple factors, including the required data transmission rate, the chosen data encoding method, motor (20) characteristics, gear box (23) ratio R, and the effect of lateral parasitic force on the linear guide track (106). The base of the cylinder (108) is rigidly connected to the output shaft (112) from the gear box (23).

FIG. 9 illustrates in 3D the sliding contact between the inclined groove (110) on the oscillating cylinder (108) and the downward tip (105) of the bypass elbow (102). The groove (110) is set at an inclination angle (111) relative to the base of the reciprocated cylinder (108). For reference, this angle is denoted as a degrees in subsequent calculations. Increasing the inclination angle (111) allows for higher maximum signal generation frequency or shorter opening/closing times for passages (68) during single pulse sequences. However, as this angle increases, the force component along the modulator assembly (21) axis decreases, while the perpendicular component increases, which leads to greater friction between the bypass elbow (102) and the linear guide track (106) (see FIG. 5). To mitigate undesirable lateral forces exerted by the bypass elbow tip (105) on the edge of the groove (110), it is necessary to limit the maximum value of angle $\alpha$. The base of the cylinder (108) is rigidly connected to the output shaft (112) from the gear box (23).

Figure 10:
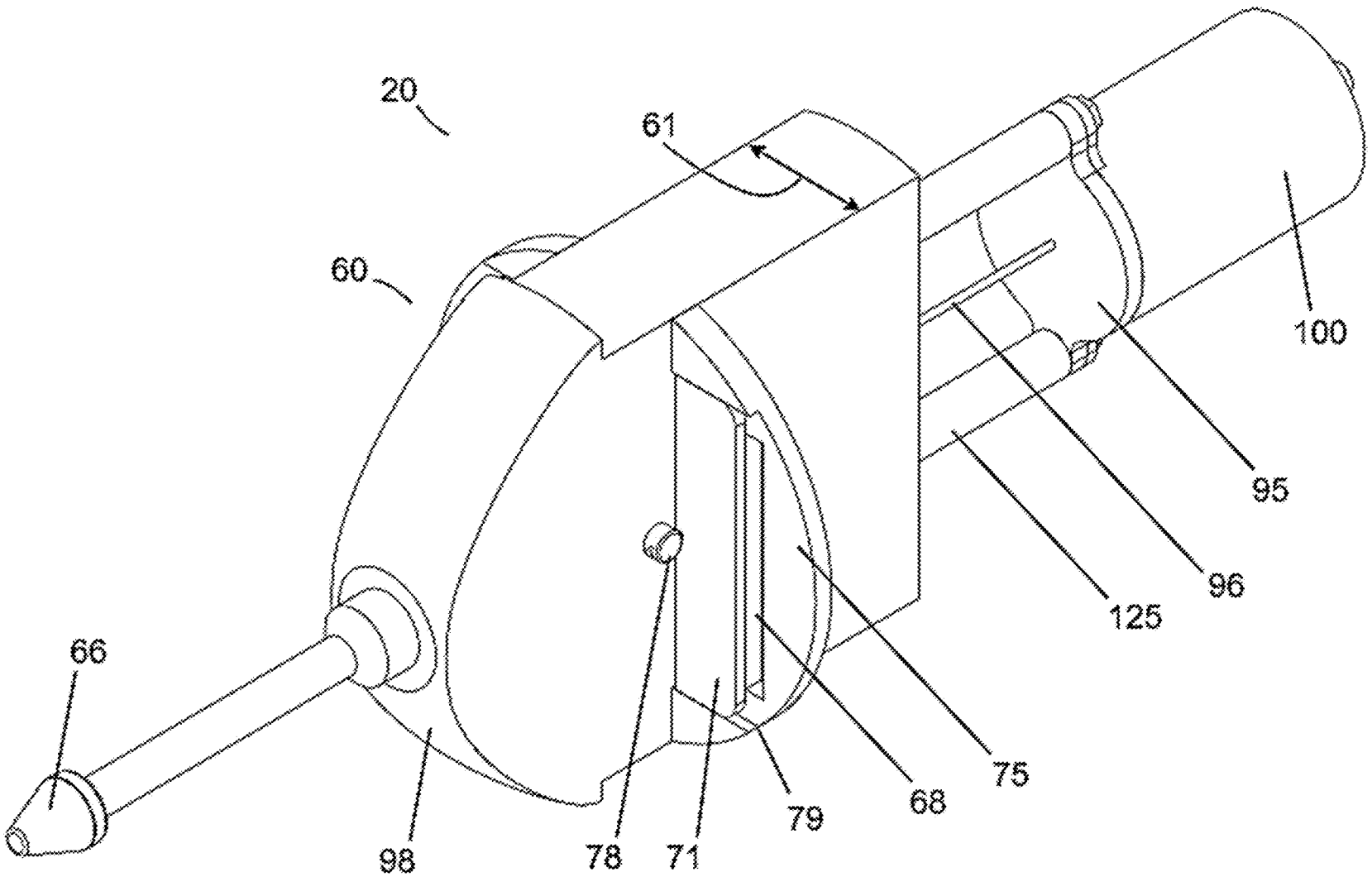
FIG. 10 is a three-dimensional (3D) view of modulator (20) according to embodiments of the present disclosure in the downward direction of the wellbore with an external supported plate (75) attached to chamber (60).

FIG. 10 provides a 3D side view in the downward wellbore direction (134) of design two of the modulator (20). This design incorporates two external supporting plates (75) equipped with elongated passage slots (68). Unlike previous designs, there is no external modulator housing (97); instead, the modulator (20) is mounted directly to an adapter (not shown). The width (61) of the chamber (60) equals the combined thicknesses of the chamber (60) walls plus the width (65) of cavity (64) (as illustrated in FIG. 2) that contains the hydraulic oil (62). The chamber walls' minimum width (61) must ensure that the seal ring (80), installed on cylinders (78), remains entirely within the chamber (60) walls throughout the full range of the cylinders' reciprocating movement. Additionally, the minimum width (65) of cavity (64) must provide a gap of at least several millimeters between the bases of the cylinders (78) when the passage slots (68) are fully open.

As the diameter of the drill collars (6) increases, the length of the elongated rectangular slots in the passages (68) correspondingly increases. To prevent the "hydraulic hammer" effect, a greater width is used for the elongated rectangular slot (68). Design two differs from the prior design by featuring a supporting plate (75) with elongated rectangular slots, which is attached to the chamber (60) via a fastening mechanism (not shown). This allows the supporting plate (75) to be replaced during modulator (20) maintenance or refurbishment at the well site. Further distinctions include the elimination of part (63) from the lower portion of the chamber (60) in design two. Additionally, in this design, connections between the linear actuator (100)

and the lower surface of the chamber (60) are reinforced using robust mounting rods (125) and an intermediate connecting plate (95).

Figure 11:
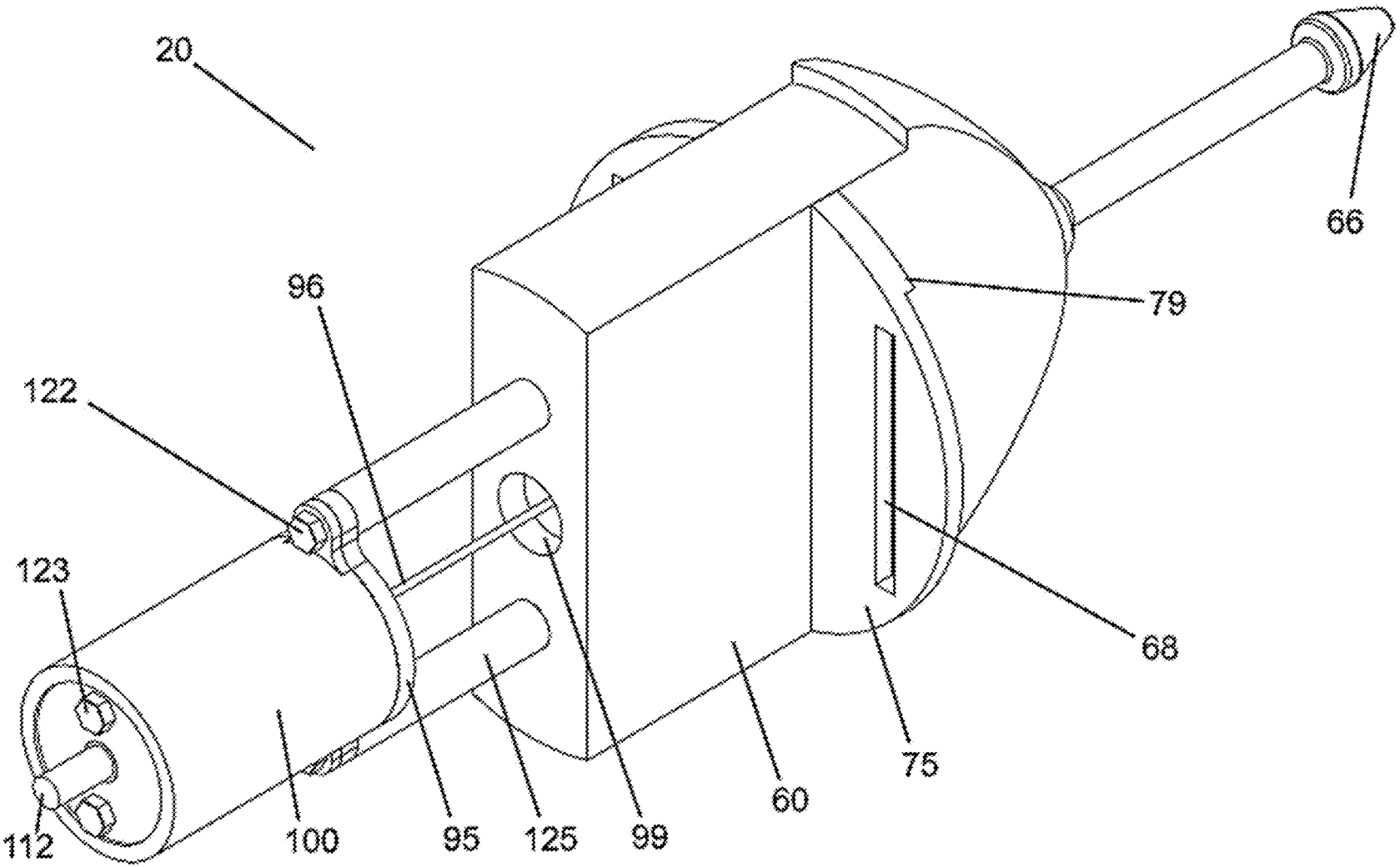
FIG. 11 is a three-dimensional (3D) side view of modulator (20) according to embodiments of the present disclosure in the upward direction of the wellbore with an external supported plate (75) attached to chamber (60).

FIG. 11 provides a 3D side view of modulator assembly (21) design two, oriented in the upward wellbore direction (132). From this perspective, the narrow, elongated rectangular slot (68) in the supporting plate (75) is clearly visible. Design two streamlines the connection between the chamber (60) and the linear actuator (100) by employing thick rods (125) that are threaded into the bottom of the chamber (60). The lower ends of rods (125) fit into holes in an intermediate connecting plate (95), which is attached to the linear actuator (100) with a fastening mechanism (not shown). Mounting bolts (122) secure rods (125) in place, and the intermediate connecting plate (95) is firmly fastened to the top of the linear actuator (100) by additional mounting bolts (not shown). The bottom section of the linear actuator (100) is secured with bolts (123).

Figure 12A:
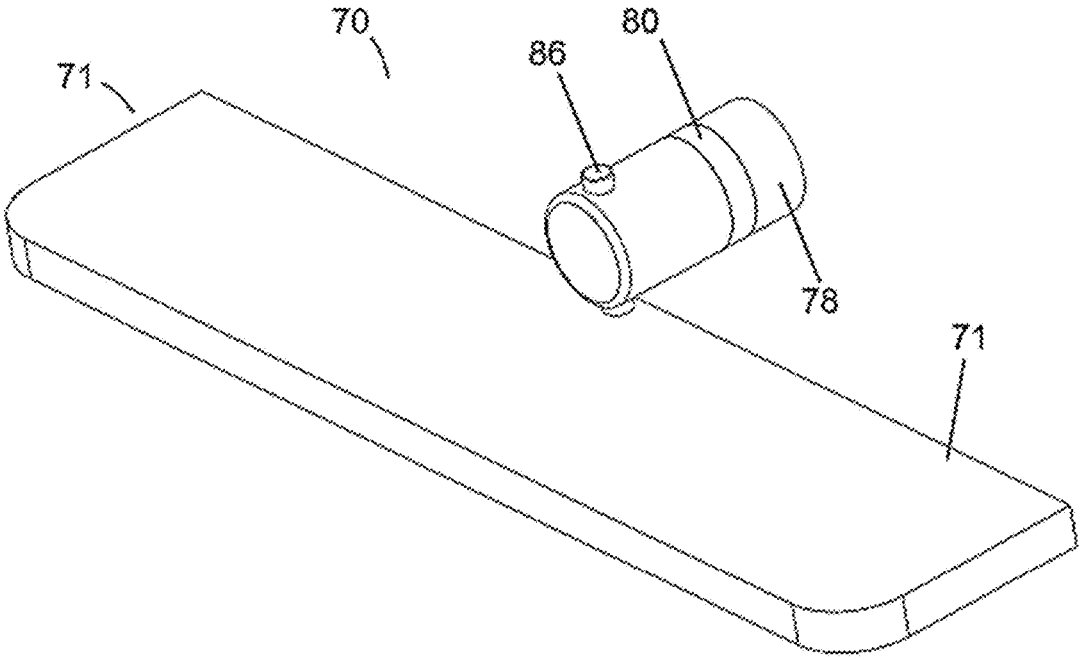
FIG. 12A is a three-dimensional (3D) side view of the reciprocated member (70) in the downward direction of the wellbore according to embodiments of the present disclosure.
Figure 12B:
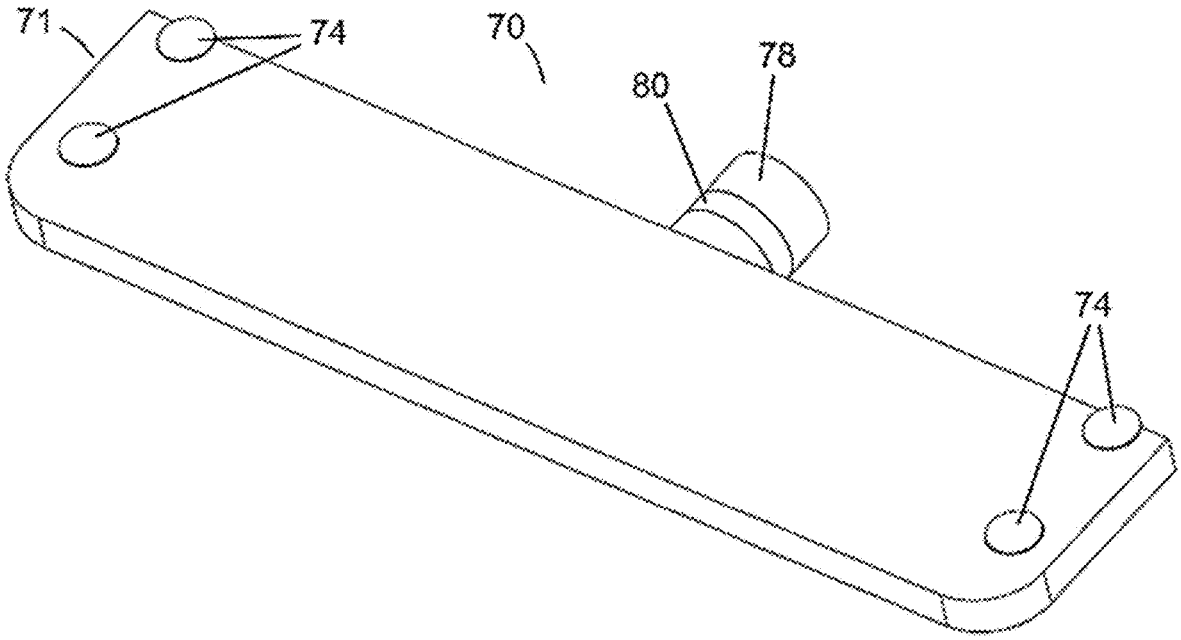
FIG. 12B is a three-dimensional (3D) view of the reciprocated member (70) in the upward direction of the wellbore according to embodiments of the present disclosure.

FIGS. 12A and 12B display the reciprocating member (70) for design two of modulator assembly (21). FIG. 12A is a 3D side view, showing that the reciprocating member (70) includes key components such as the reciprocating plate (71), sliding cylinder (78) with seals (80), and rod (86), similar to the corresponding assembly in design one (described in FIGS. 7A, 7B, and 7C). The principal difference is the absence of front limiters (73), which were present in the previous design. FIG. 12B shows a 3D side view in the upward wellbore direction (132), highlighting the metal inserts (74) attached to the reciprocating member (70). These inserts are coated to prevent wear during repeated sliding contact along the surface of plate (75). To prevent rapid wear, both the inserts (74) and their mating surface on plate (75) should have similar coatings and comparable strength properties. Inserts (74) positioned near the outer surface of chamber (60) extend slightly beyond the reciprocating plate (71) to provide an essential gap for maintaining hydrostatic balance around it. It is important that the inserts (74) do not project more than about 0.05-0.1 mm below the surface of the restrictor plate (71), to prevent undesired cross-flow of drilling fluid (32) perpendicular to the axis of the modulator assembly (21).

Figure 13:
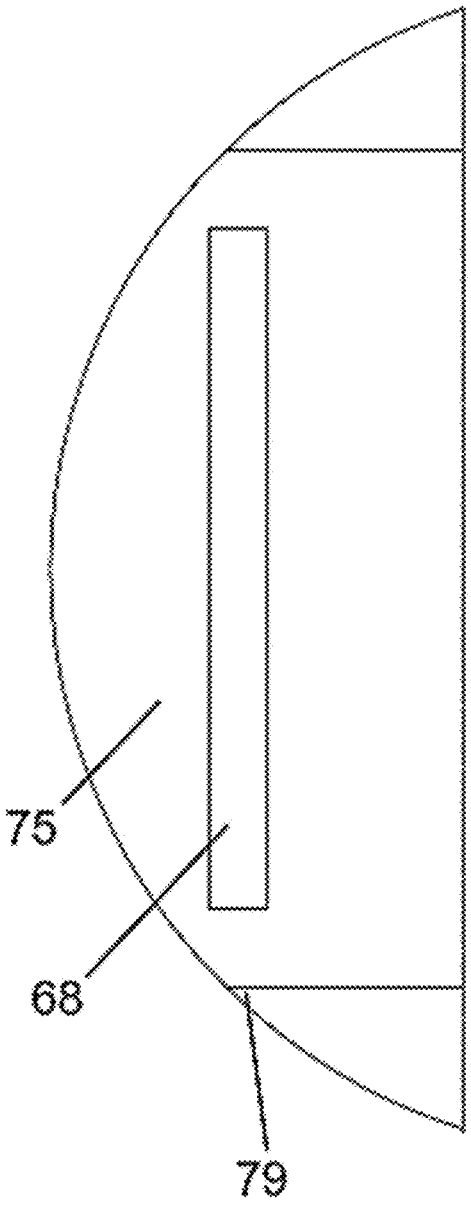
FIG. 13 is a three-dimensional (3D) view of modulator (20) in the downward direction of the wellbore according to embodiments of the present disclosure without external protective body (97) with supported plate (75) attached to the side wall of the chamber (60) shown on FIG. 11.

FIG. 13 is a view of modulator (20) design two in the downward wellbore direction, showing the supporting plate (75) attached to the chamber (60) side wall. This perspective illustrates that the reciprocating movements of the plate (71) are constrained to the direction perpendicular to the modulator axis due to the presence of side limiters (79). The reciprocating plate (71) is longer than the length of flow passage (68) to accommodate the inserts (74) (see FIG. 12A). The inserts (74) enable low-friction sliding contact between the reciprocating plate (71) and supporting plate (75).

Figure 14:
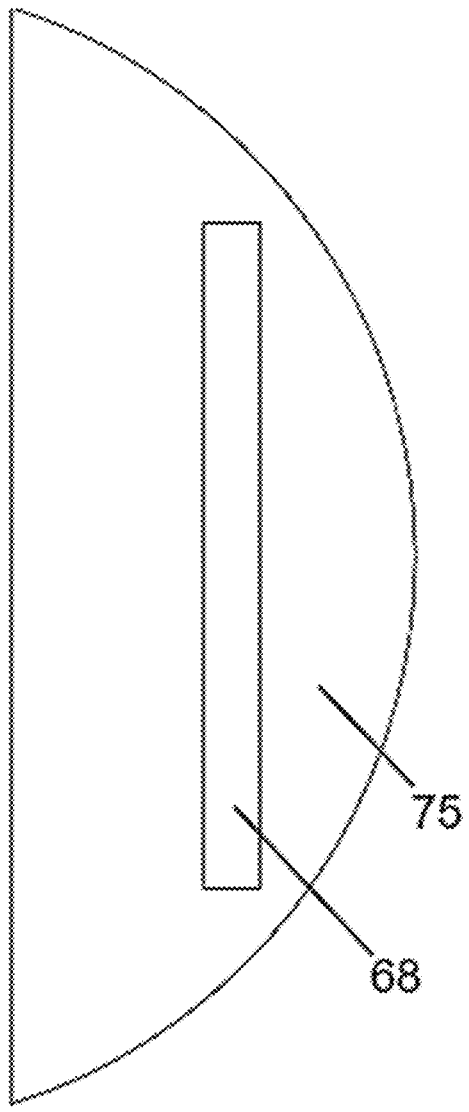
FIG. 14 is a three-dimensional (3D) view of modulator (20) according to embodiments of the present disclosure in the upward direction of the wellbore without an external protective body (97) with supported plate (75) attached to the side wall of the chamber (60).

FIG. 14 offers an upward view of the modulator (20) design two, with the supporting plate (75) attached to the chamber (60) side wall. In contrast to design one, design two omits the external protective body (97). The drilling fluid flow passage (68) possesses an elongated rectangular shape. To minimize wall erosion in areas with sharp angles, it is recommended to use smoothly contoured surfaces around passage (68) rather than abrupt corners. The distance between passage (68) and the outer wall of chamber (60) is minimized to maximize the passage area and minimize the area of plate (71). Reducing the area of plate (71) decreases the impact force of drilling fluid (32) on the plate, thus reducing the friction force at the sliding interfaces between plates (71) and (75). Bolts (122) fasten the lower portion of chamber (60) to the upper section of the linear actuator (100) via rods (125) (see FIGS. 10 and 11). Bolts (123) secure the lower cover of the linear actuator (100). The output shaft (112) of gearbox (23) is equipped with a seal (not shown) to prevent leakage of lubricant (103) from the gearbox (23).

FIGS. 1-14 illustrate the various designs and functional aspects of the modulator assembly (21) according to embodiments of the present invention. A distinguishing feature of the modulator assembly (21), in both design one and design two, is its simplicity and efficiency compared to conventional commercial pulsers. Notably, these designs eliminate the need for multiple bearing systems typically found in existing oscillated pulser devices. A key advantage of both designs is that the drilling fluid pressure (32) outside the chamber (60) and the hydraulic oil pressure (62) inside cavity (64) are maintained in near-perfect balance. This pressure equilibrium allows the reciprocating movement of the plate (71) to be controlled with relatively minimal force applied to the piston (90). The innovative approach to the modulator assembly (21) not only streamlines the mechanism but also delivers significant operational and maintenance advantages, including the ability to service the assembly directly at the rig site.

To achieve optimal performance from the proposed modulator assembly (21) during directional drilling operations, it is essential to undertake a systematic process of planning and parameter selection. This process ensures the modulator assembly (21) is specifically tailored to the requirements of the drilling program and the needs for high-quality geological and drilling data collection. Because each well is unique—differing in purpose, design, trajectory, depth, and other factors—careful and deliberate planning is of paramount importance. The planning stage (200), shown in FIG. 15, comprises a sequence of steps (201-215) designed to guide the efficient selection and optimization of the modulator assembly's parameters. Although these steps are presented in sequence for clarity, the process itself is inherently iterative, encouraging ongoing adjustment and refinement as new data and requirements emerge.

For successful application of the proposed modulator assembly (21) designs, it is necessary to follow a series of stepwise procedures to select optimal component parameters in the context of the specific drilling program and information needs. Since no two wells are exactly alike, the planning stage is fundamental. Using the modulator assembly (21) in conjunction with the BHA system (22) and the methodologies described herein, the planning stage outlines the process for selecting the most suitable design options and operational parameters to fulfill both drilling and geological objectives. The steps involved in the planning stage (200) for directional drilling—based on the use of the modulator assembly (21)—are depicted in FIG. 15.

Step 201: Gathering Information

In this step, collect essential information about the area, specific well, or group of wells where the modulator assembly (21) will be used. The main factors to gather are: drilling fluid density ($\rho$); drilling fluid flow rates in different intervals; drill collar diameters; maximum true vertical depth (TVDmax); and required real-time data transmission rate for the deepest part of the well.

Using this information, two important parameters are either selected or calculated. The compensatory pressure (Pcomp) to be applied to the hydraulic oil inside the chamber (60) using piston (90), so that the pressure around the chamber is balanced. The required data transmission speed (in bits per second, bps) for the deep section of the planned well(s).

The compensatory pressure is calculated using Equation 1:

$$Pcomp = TVD\max \times \rho \times A \quad (1)$$

where Pcomp is compensatory pressure, TVDmax is maximum true vertical depth (meters, m), ρ is drilling fluid density (g/cm$^3$), and A is cross-sectional area of the output shaft (mm$^2$).

The cross-sectional area A should be the smallest value that still ensures the strength of the shaft (96). As the output shaft is only loaded in axial compression, a typical range is 1-2 mm$^2$. Example using Equation 1: If TVDmax=5,000 m, ρ=1.2 g/cm$^3$, and A=1 mm$^2$: Comp=5,000×1.2×1=6.0 kg/cm$^2$ or 5.8 atm.

At this stage, also determine the needed amount of measurement and logging-while-drilling data, and the required real-time transmission speed for the deepest part of the well. Commercial pulsers and common signal encoding methods can satisfy data transmission needs in shallow and mid-depth well sections. However, in deep sections, real data rates are often low (about 0.5-2 bps), which often is insufficient for comprehensive geological and drilling requirements. The current industry standard involves compressing data heavily, which can compromise data quality. Also, beyond low data transmission rates for deep horizons, another critical issue not resolved in the present art technology is decrease of successful decoding rate while TVD and measured depth for deep wells are increasing.

The modulator assembly (21) and the method described here make it possible to reliably transmit data at significantly higher rates—at least 6 bps—even at great well depths. For illustration, examples are given using required data transmission rates of 6 and 12 bps at this planning stage.

Step 203: Selection of Encoding and Data Transmission Method

In this step, select the encoding and data transmission technique, using the physical transmission rate identified in Step 201. If the required transmission rate is 4 bps or less, available options include pulse-sequence methods or carrier frequency modulation. If a higher physical rate of 6 bps or more is needed, consider advanced options such as carrier frequency modulation or the combinatorial frequency alphabet scheme (see U.S. Pat. No. 11,459,877).

As an example, consider a well with a true vertical depth (TVD) of 5 km. In typical geological and drilling conditions, the highest usable frequency (fmax) is generally limited by signal attenuation and noise, and is usually 6 Hz or lower. For carrier frequency modulation, transmitting 1 bit per cycle at 6 Hz translates to a bit being sent every 166 ms. However, with noise, it is often necessary to use a longer frame—such as doubling the period to 333 ms—which results in a lower data rate of 3 bps.

In contrast, the combinatorial frequency alphabet scheme (U.S. Pat. No. 11,459,877) transmits combinations of orthogonal frequencies within each time frame, not just single bits. The shortest practical frame is 500 ms (or 512 ms when using Fast Fourier Transform). For a 500 ms period, three orthogonal frequencies are feasible: 2, 4, and 6 Hz. To transmit at 6 bps, it requires sending 3 bits every 0.5 seconds having 8 unique signal combinations. Just by using two phase for each frequency (for example, 0° and) 180°, and transmitting single harmonics and summed combinations of two frequencies, the total number of possible combinations is 21. This enables transmission of up to 4.4 bits per 0.5 seconds or 8.8 bps.

In more favorable conditions, the system can reach rates up to 12 bps with a maximum frequency of 12 Hz. For carrier frequency modulation at 12 bps, the telemetry system must send one bit every 82 ms. Applying the combinatorial frequency alphabet method at the frequency range 2-12 Hz and 0.5-second frame, allows to use six orthogonal frequencies: 2, 4, 6, 8, 10, and 12 Hz. With two phases for each harmonic, there are 12 single-frequency possibilities and 66 combinations of two summed frequencies, forming an alphabet of 76 combinations. This allows transmission of about 6.25 bits per 0.5 seconds or 12.5 bps. Notably, this method achieves the same data rate as basic carrier modulation but with a signal generation window that is six times longer than a single 12 Hz cycle (82 ms), resulting in a 2.45-fold higher signal-to-noise ratio.

This step responsible for the selection of the data transmission method based on the requirements for ensuring drilling and geological objectives. Depending on the selected method of the data encoding and transmission the maximum operating frequency (fmax) or minimum opening/closing time (tmin) is determined. For the example going forward, for a favorable subsurface and technical environments, a carrier frequency modulation method is chosen, using carrier frequency equal to 12 Hz for the 12 bps data transmission rate for the deep section of the well.

Step 205: Determining Width and Range

This step determines the optimal width for the drilling fluid flow passage (68), which is a key parameter for efficient operation of the modulator assembly (21): Design one: The width of the fluid passage (68) equals the distance (67) between the inner surface of the modulator's outer body (97) and the outer surface of the chamber (60). Design two: The width is defined by the elongated rectangular slot (68) in the supporting plate (75).

Based on the selected optimal width (Wopt), estimation of the amplitude of the pressure fluctuations (50) generated by the modulator assembly (21) is performed. The final part of this step involves analyzing the external drilling fluid pressure and friction forces that must be overcome by the piston (90) to move the cylinders (78) and reciprocating plate (71), especially for the deep sections of the well.

As the drilling fluid passes through the flow passage (68), it creates a positive pressure jump (ΔP) between the fluid pressure at the tip of the cylinder (78) and the pressure at the base of the piston (90). The criterion for selecting Wopt is based on the following: If the passage width exceeds Wopt, the positive pressure jump ΔP decreases only slightly. If the passage width is less than Wopt, the pressure gradient ΔP increases rapidly. For systems generating single pulses, Wopt should also allow for a safety margin to avoid the "water hammer" effect, especially when pulse duration is greater than 100 ms.

Estimating Wopt and the resulting pressure wave amplitudes can be done using analytical equations, experimental flow loop testing, or preferably through numerical modeling.

Figure 16:
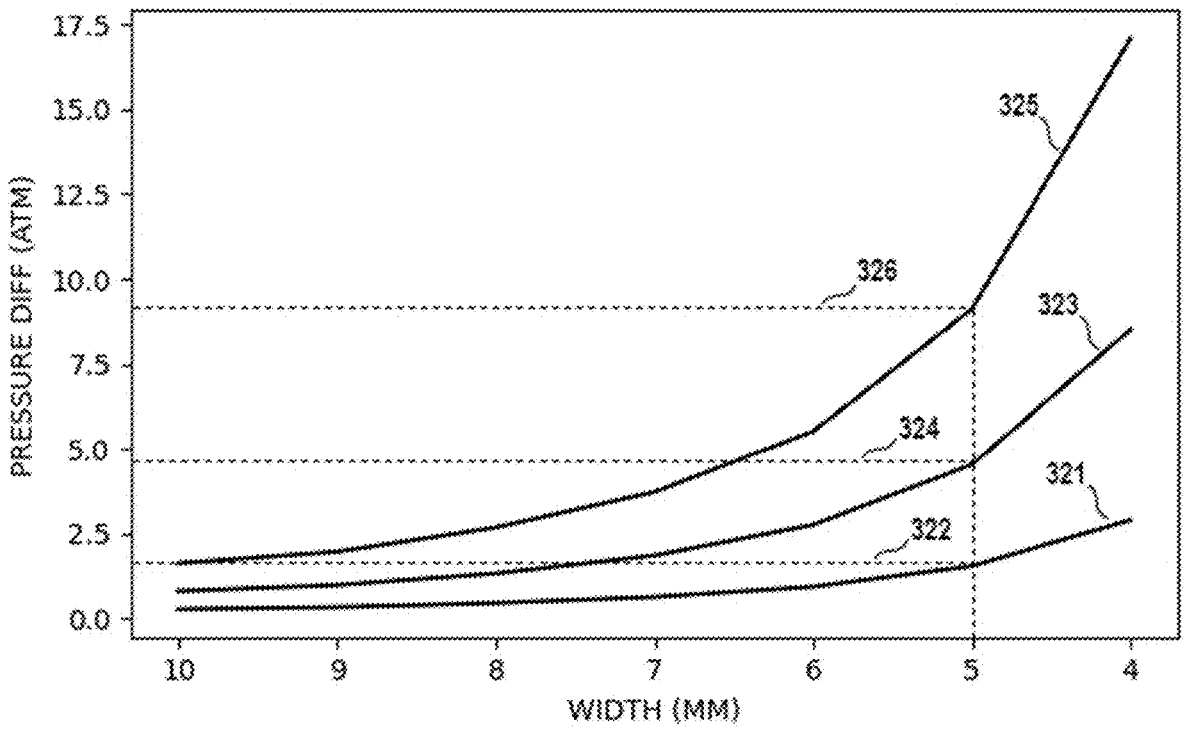
FIG. 16 shows graphs of the dependence of the pressure difference of the drilling fluid pressure between the level at the cylinder (78) and the base of the piston (90) from the width (67) for the fully open drilling fluid flow passage (68) for three different fluid flow rates (9.01 l/s, 15.5 l/s and 22.01 l/s).
Figure 17:
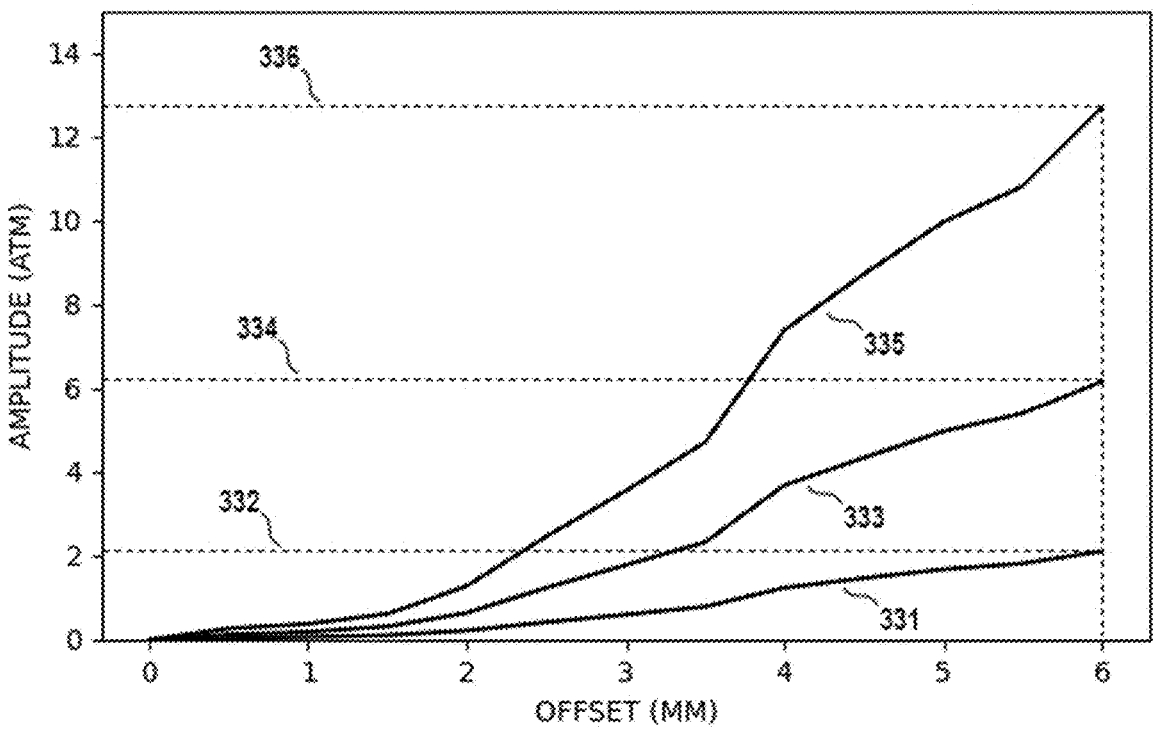
FIG. 17 shows graphs of the pressure of the drilling fluid fluctuation (50) for three different drilling fluid flow rates (graph 331 for Q=9.0 l/s; graph 333 for Q=15.5 l/s; graph 335 for Q=22.0 l/s) at different positions of the plate (71) for width (67) equal to 6 mm.

FIGS. 16 and 17 present the results of computational studies used to estimate Wopt and pressure wave amplitudes at different flow rates. These were obtained using Computational Fluid Dynamics (CFD) software, which solves the fluid flow equations—conserving mass, momentum, and energy—using advanced numerical techniques. CFD simulations discretize the computational domain, providing detailed insight into fluid dynamics and their effects on equipment and the surrounding environment. (see, e.g., Anderson, J. D., "Computational Fluid Dynamics: The Basics with Applications," McGraw-Hill, 1995; Versteeg and Malalasekera, "An Introduction to Computational Fluid Dynamics: The Finite Volume Method," Pearson, 2007).

A three-dimensional model of the modulator (20), with a 4.75-inch diameter, was placed inside the drill collar (6). The fluid inlet was modeled as the main channel of the drill collar from the upper wellbore section. Simulations were conducted at three drilling fluid flow rates: Q=9, 15.5, and 22 liters per second (l/s). Various positions of the reciprocating plate (71) were analyzed to represent progressive restriction of the drilling fluid flow (32) through the modulator assembly passages (68).

FIG. 16 shows the relationship between the pressure difference across the modulator specifically, between the drilling fluid pressure at the level of cylinder (78) and at the base of piston (90)—for different widths of passage (68), with no obstruction by plate (71), and for all three flow rates. Graphs (321), (323), and (325) correspond to flow rates of 9.0, 15.5, and 22.0 l/s, respectively.

Based on these results, the optimal passage width (Wopt) was found to be in the range of 5-6 mm. For instance, with Wopt=5 mm and a maximum flow rate (Q=22 l/s), the resulting pressure difference (ΔP) is 9.1 atm (position 321). At an average flow rate (Q=15.5 l/s), ΔP is 4.8 atm (position 324), and at the minimum flow rate (Q=9.0 l/s), ΔP is 2.0 atm (position 322). For robust operation of the modulator assembly (21) under the most demanding conditions, the maximum ΔP value corresponding to the highest flow rate should be used as the design basis.

FIG. 17 presents graphs of drilling fluid pressure fluctuation (50) for the three flow rates: graph (331) for Q=9.0 l/s, graph (333) for Q=15.5 l/s, and graph (335) for Q=22.0 l/s, at various positions of plate (71), with Wopt=6 mm. A substantial change in pressure is observed once flow is obstructed by plate (71) by 2.0 mm. From 2.0 to 6.0 mm of obstruction, increasing restriction by plate (71) produces a nearly linear pressure response, supporting the choice of a 4 mm reciprocation range for plate (71).

At Q=22 l/s, the maximum amplitude of pressure fluctuation (50) is 12.70 atm (position 336); at 15.5 l/s it is 6.18 atm (position 334); and at the minimum flow rate of 9.0 l/s, the amplitude is 2.11 atm (position 332). The lowest value may be insufficient for reliable signal decoding at well depths of 5,000 meters.

Within the selected reciprocation range of 2 to 6 mm, signal amplitudes should be adjusted based on the amplitude when passage (68) is initially obstructed by 2 mm. The required corrections are 1.28, 0.64, and 0.22 atm for the three flow rates, respectively. After these corrections, the maximum pressure fluctuation (50) for each flow rate becomes 11.42, 5.54, and 1.89 atm.

With steps (201), (203), and (205) complete, all key parameters and operating modes for the modulator assembly (21) have been established, allowing progression to the subsequent design phases (207), (209), and (211).

In the preceding steps, the maximum modulation frequency (fmax) was set at 12 Hz, and the optimal passage width (Wopt) was determined as 6 mm. Achieving carrier frequency modulation at 12 Hz requires the reciprocating plate (71) to travel from an initial position that partially obstructs the passage (68) by 2 mm to a fully closed position, resulting in a total stroke of 42 milliseconds (the half-period of a 12 Hz signal)-confirming the actuator and hydraulic system must be designed for precise and rapid reciprocated plate (71) shifts within this narrow operating window.

Step 207: Calculating Chamber Pressure

In step (207), the minimum value of ΔPmax required is calculated. This represents the additional hydraulic oil (62) pressure created by actuation of the piston (90), ensuring that the pressure in chamber (60) can overcome external drilling fluid pressures and all friction forces during operation of piston (90), cylinder (78), and plate (71) under the most demanding conditions. Specifically, the hydraulic oil pressure must generate a force equal to or greater than the sum of: (i) Compensatory pressure (Pcomp): Provides hydrostatic balance around chamber (60) (see step (201)) when passages (68) are open. (ii) Drilling fluid pressure difference (ΔP): At maximum flow rate (Qmax), with passages (68) open. (iii) Maximum signal pressure (Psignal max): At the closed position of plate (71) for Qmax. (iv) Friction losses: Pressure required to overcome friction in piston (90) and cylinder (78). (v) Restrictor plate friction: Pressure required to move plate (71) against its support.

In this example: Pcomp max at 5,000 m TVD, density 1.2 g/cm$^3$, area 1 mm$^2$=5.8 atm (see step (201)). ΔP for passage (68) (Wopt=6 mm)=5.8 atm. Psignal max at plate (71) fully closed for Qmax=22 l/s, is 12.70 atm (position 336). Estimated total friction losses (piston, cylinder, plate)=3.0 atm (to be refined with prototype testing). Therefore, ΔPmax min is the sum: ΔPmax min=5.8+5.8+12.7+3.0=27.3 atm.

Step 209: Determining Range of Movements

During step (209), the maximum required force, Fmax, acting on piston (90) is calculated in order to generate a pressure increase in hydraulic oil (62) equal to ΔPmax. The value of Fmax depends also on the cross-sectional area, Sp, of piston (90).

The value of Sp, the cross-sectional area Scyl of cylinder (78), the number of cylinders M, the maximum travel distance Lcyl of cylinder (78), and the maximum travel distance Lp of piston (90) are interrelated by Equation 2:

$$Lp = Lcyl * M * Scyl/Sp \tag{2}$$

For the preferred case, M=2. According to previous steps, Lcyl was defined as 4 millimeters. To minimize the force required to achieve the desired pressure increase ΔPmax in hydraulic oil (62) within cavity (64), it is advantageous to minimize value of Sp, beginning with minimization of Scyl-cross-sectional area of cylinder (78). In the proposed designs of modulator (20), the rod (86) is inserted into a hole at the outer end of each cylinder (78). The minimum diameter of cylinder (78) is therefore constrained by the diameter of rod (86). The rod (86) must withstand transverse loads and accommodate the installation of safety bolt (88). To satisfy these mechanical requirements, the radius of rod (86) must be at least 2 mm, and the radius of cylinder (78) should fall within the range of 3 to 5 mm. In this example, the radius of cylinder (78) is selected equal to 4 mm, yielding a cross-sectional area, Scyl, of approximately 0.5 cm$^2$. Consequently, according to equation (2), the cross-sectional area Sp of piston (90) is equal to 1.0 cm$^2$.

Given a ΔPmax of 27.3 atmospheres, the maximum force, Fmax, required to be exerted on piston (90) is calculated to be approximately 28.2 kg/cm$^2$. This force is applied to piston (90) provides the desired hydraulic pressure. The selected values of the cross-sectional areas of the piston shaft (96) and the rod (86) provide solid mechanical integrity.

Step 211: Determining Parameters of Linear Actuator

Next step (211) involves determining parameters of the linear actuator (100), such as the radius of the cylinder (108), the angle (111) of the guided track (110) on the cylinder 108, as well as the maximum angular speed (Max) of the motor (18,) the motor (18) power, and gear box (23) ratio R, which together enable reciprocated movement of piston (90) while generating a signal with frequency fmax. In our example, the chosen parameters should ensure that the piston (90) can move a distance of 4 millimeters within half of the period at the selected max of 12 Hz, the half period is 42 milliseconds. The cylinder (108) must rotate by an angle that displaces the tip (105) of the bypass elbow (102) by a circumferential distance equal to Lp/tan (a), where a is an angle (111) of the inclined groove (110).

Initially, the angle α of the guided track (110) is selected in the range of 10-20 degrees. In this range, the axial force component remains within 2-6% of the total applies force, and parasitic lateral forces are within 17-34% of the total force. Due to the low friction sliding contact between the bypass elbow (102) and guided track (106), the effect of lateral forces on actuator (100) performance is negligible for α=10 degrees. However, for a exceeds 20 degrees, their effect should be considered.

In this example, an angle α of 15 degrees is chosen. For α=15 degrees, moving piston (90) by 4 millimeters results a corresponding horizontal displacement by 14.8 mm of circumferential movement along the cylinder (108) relative to the bypass elbow (102). The angular displacement depends on the outer radius of the cylinder (108). Depending on the design of linear actuator (100), the possible range for radius of the cylinder (78) for a 4.75-inch drill collar could be between 12 mm and 21 mm. For a radius of 12 mm, the 14.8 mm displacement along the circumference of cylinder (108) corresponds to a rotation of 70.7°, while for radius of 21 mm this corresponds to 40.4°.

The gear box (23) ratio (R) is calculated to ensure the required rotation is completed within 42 ms, accounting for the average rotational speed of the motor (18) (assumed here to be 4,000 rpm, or 66.7 revolutions per second). For (r)=12 mm, the required gear box (23) ratio (R) is 14:1. For (r)=21 mm, the required ratio is 25:1.

The gear box (23) ratio (R) that enables the piston (90) to traverse the calculated stroke within the specified time (half-period of fmax is determined by Equation 3:

$$R = \pi * r * N\max * \tan(a)/120 * f\max * Lp \quad (3)$$

where π=3.14, r is the radius of cylinder (108), Nmax—the maximum safe revolutions per minutes for motor (18), α is an angle (111) of the inclined groove (110), fmax is the maximum signal frequency (highest harmonic of the encoding scheme), Lp—is the stroke of the piston 90.

The process of selection the motor (18) parameters to achieve fmax is known in the present art technology and is not described here in detail.

Step 213: Programming Surface and Downhole Equipment

The final step of the planning stage (200) is step (213), which involves programming the surface and downhole equipment, implementing the encoding schemes, developing downlinking commands, and performing other preparatory steps necessary for drilling operations. This includes configuring software and hardware subsystems of the Measurement While Drilling/Logging While Drilling (LWD) system to ensure seamless integration and operation during the drilling process.

After completion of stage 200 the Drilling Operation stage 300 is started.

Figure 18:
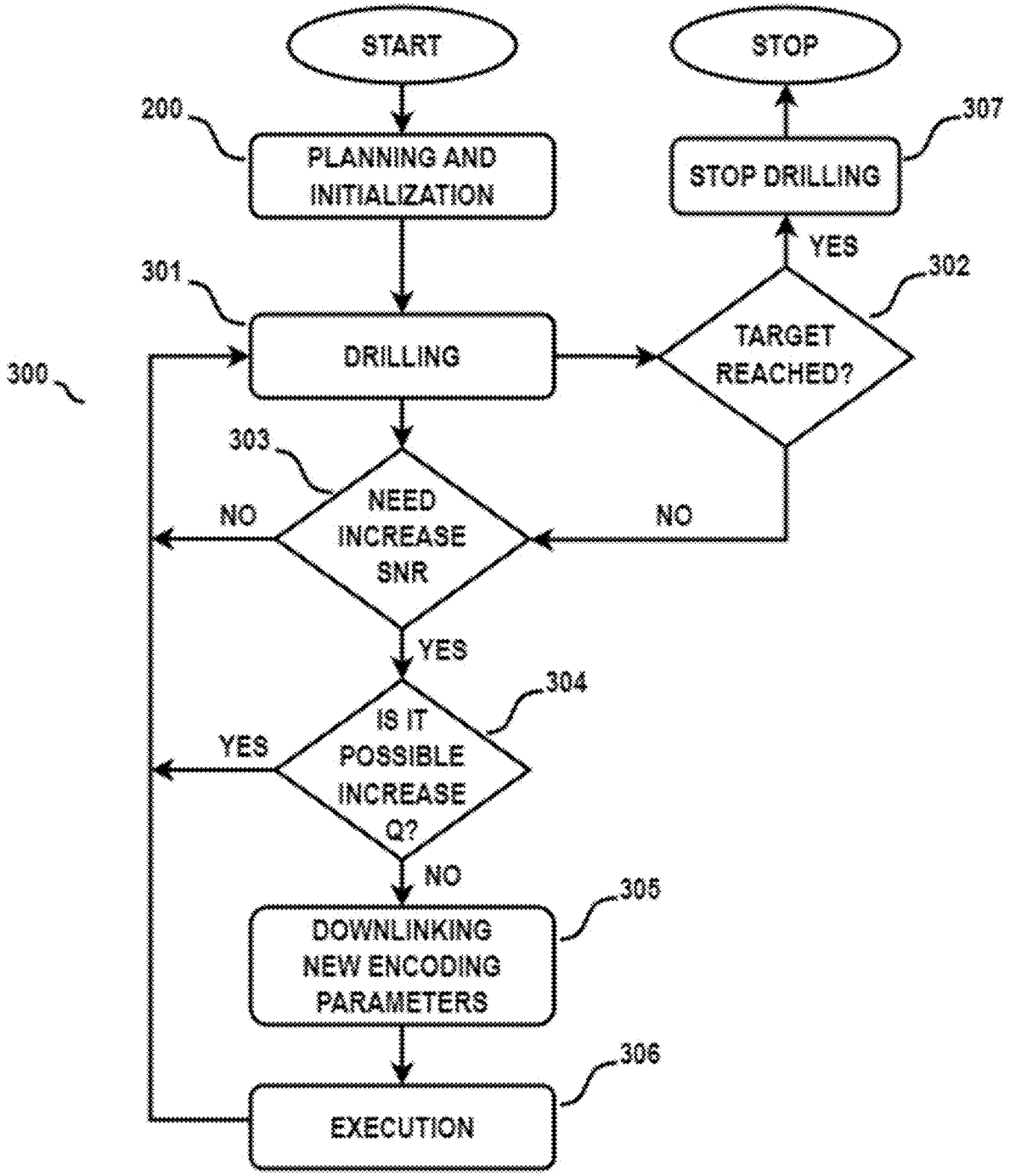
FIG. 18 shows a workflow of directional drilling operation using modulator assemblies (21) and associated methods in accordance embodiments of the present disclosure.

FIG. 18 shows a schematic illustration of at least one embodiment of the invention in use during stage (300).

Step 301: Drilling

The first step on the stage 300 is a step 301—Drilling. Drilling is carried out using a modulator assembly (21) comprising a modulator (20), a linear actuator (100), a gear box (23), a motor (18), a motor driver with controller (19), and other standard modules and components typical of an MWD/LWD system and Bottom Hole Assembly (BHA). The configuration of the modulator assembly (21), combined with the parameters of the encoding scheme, enables the required data transmission rate and ensures reliable detection and decoding of signals throughout drilling. During drilling the system constantly evaluate if the target is reached (step 302) and if increase of signal to noise (SNR) is needed (step 303).

Step 303—Operational Monitoring of SNR

During drilling, step (303) involves the continuous assessment of signal detection quality and decoding accuracy. If the signal-to-noise ratio (SNR) falls below a predetermined level, the system evaluates options to restore or improve communication reliability.

Step 304—Adjusting Fluid Flow Rate Option

During step (304), the possibility of increasing the drilling fluid (32) flow rate (Q) is considered. If feasible, Q is increased to enhance the SNR, and drilling continues with improved signal quality. If increasing the flow rate is not possible due to drilling requirements or limitations, the process proceeds to step (305).

Step 305—Adaptive Encoding Scheme Adjustment

At step (305), the encoding scheme parameters are dynamically adjusted to maintain communication quality and downlinking to BHA. The specific method depends on the modulation technique in use. Single-Pulse Methods: Improving SNR requires increasing the width of generated pulses, which reduces the data transmission rate below the specified requirements. Carrier Frequency Modulation Methods: There are two primary options: (i) Extend Time frame per signal: Increasing the duration allocated for each signal, while maintaining a constant carrier frequency, reduces the data rate (e.g., doubling the time per signal halves the data rate). (ii) Lower Carrier Frequency: Decreasing the carrier frequency is preferable because signal attenuation is proportional to the square of frequency. For example, reducing the carrier frequency from 12 Hz to 10 Hz provides a 1.4-fold SNR improvement (using one period of the 10 Hz carrier, which is 100 ms-equivalent to doubling the frame for a 12 Hz carrier in the first option), while the data rate decreases by only 17% (from 12 bps to 10 bps), compared to a 50% reduction when extending the time per bit.

Advanced Modulation Strategies: As taught in U.S. Pat. No. 11,459,877, further methods to improve SNR include: (i) Increasing the time frame for signal generation, (ii) Reducing the maximum signal frequency (fmax), (iii) Increasing the number of phases for each frequency, and (iiii) Using any combination of the above strategies.

Utilizing of one or a combination of the above options allows the system to ensure that the physical information transmission rate meets the requirements of the drilling and geological programs for the drilling well. When the need to increase signal-to-noise ratio is recognized, at the step 305 an appropriate combinatorial encoding scheme is selected and a corresponding command is downlinked and executed at the step 306. The new encoding scheme is used for the continuation of the drilling operations (step 301). When the target depth is reached (step 302), the drilling operation is completed and stopped (step 307).

REFERENCE NUMBER LIST

1—rig
2—borehole
3—earth
5—formation
6—drill string
8—drill bit
9—centralizer(s)
10—Rotary Steerable System (RSS)
11—flow sensor
12—sensor module
13—downhole transducer
14—source of energy
15—annulus space
16—controller
17—borehole wall
18—motor
19—motor driver with controller
20—modulator
21—modulator assembly
22—Bottom Hole Assembly (BHA)
23—gear box
30—mud pit
32—drilling fluid
34—pump
36—fluid mud line
38—transducers
40—analog/digital device
42—processing device
50—pressure fluctuation
51—modulator for downlinking
52—transducer at drilling fluid flow line
54—remote location center
55—stand pipe gauge for pressure
56—hook load sensor
57—depth tracking sensor
60—hydraulic oil chamber
61—width of chamber 60 above cylinders 78
62—hydraulic oil
63—downward part of modulator 20
64—cavity for hydraulic oil 62
65—width of cavity 64
66—extraction tip
67—distance between drill collar 6 and lower part of chamber 60.
68—drilling fluid passage holes
69—space between the bottom 92 of chamber 60 and downward part of modulator 20
70—reciprocated member
71—reciprocated plate
73—frontal limiter for reciprocated plate 71
74—round insert
75—supported plate with elongated passage 68 attached to chamber 60
76—gap between the reciprocated plate 71 bottom and protrusion surface 77
77—protrusion surface on the side of chamber 60
78—locking sliding cylinders
79—limiter for plate 71
80—seal of the locking cylinders
86—rod connecting cylinder and restrictor
88—limiter ion the rod 86
89—rounded end of the rod 86
90—reciprocating piston
91—seal for piston 90
92—chamber 60 bottom
93—bolts
94—holes for mounting the linear actuator block
95—intermediate connecting plate
96—shaft connecting piston with actuator block
97—device body
98—top of the modulator
99—cylindrical channel for piston 90
100—linear actuator
101—cavity for lubricant
101—internal cavity of linear actuator 100
102—bypass elbow
103—lubricant
104—fastening mechanism between shaft 96 and bypass elbow 102
105—downward end of the bypass elbow 102
106—linear guide track
107—top surface for actuator 100
108—cylinder
110—guide track on cylinder 108
111—angle of groove 110
112—output shaft from gear box
114—seals on the top of actuator block 110
116—seals on the bottom of actuator block 110
118—fastening bolts
122—bolts
123—bolts
125—mounting rod connecting chamber 60 and linear actuator 100
132—uphole direction
134—downhole direction
140—protective case for upper part of BHA While one or more embodiments have been shown and described, modifications and substitutions may be made thereto without departing from the spirit and scope of the invention. Accordingly, it is to be understood that the present invention has been described by way of illustration and not limitation. It will be recognized that the various components or technologies may provide necessary or beneficial functionality or features. Accordingly, these functions and features may be added or removed as needed in support of the appended claims and variations thereof, and are recognized as being inherently included as a part of the teachings herein and a part of the invention disclosed. In addition, while the invention has been described with reference to exemplary embodiments, it will be understood that various changes may be made and equivalents may be substituted for elements thereof without departing from the scope of the invention. In addition, many modifications to the exemplary system and method may be envisioned to adapt a particular instrument, situation or material to the teachings of the invention without departing from the essential scope thereof. Therefore, it is intended that the invention not be limited to the particular embodiment disclosed as the best mode or preferred mode contemplated for carrying out this invention, but that the invention includes all embodiments falling within the scope of the appended claims. While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made explicit herein, without departing from the spirit and scope of the invention.

The invention claimed is:

1. A hydrostatically compensated modulator assembly for generating pressure wave fluctuations in drilling fluid flow, the hydrostatically compensated modulator assembly comprising:

a housing having two or more drilling fluid flow passages, each passage of the two or more drilling fluid flow passages configured as either (a) a gap between an inner surface of the housing and an outer surface of a chamber within the housing, or (b) an elongated slot in a supporting plate fastened to the chamber within the housing;

the chamber within the housing filled with hydraulic oil;

two or more reciprocating members disposed substantially perpendicular to a wellbore axis and at least partially within the chamber, each reciprocating member of the two or more reciprocating members operatively associated with a respective drilling fluid flow passage and operatively connected to an obstruction portion that is positioned to partially or completely obstruct said drilling fluid flow passage during operation, wherein said connection transmits lateral movement from the reciprocating member to the obstruction portion for obstruction of the passage while permitting axial freedom of relative motion, such that kinetic energy resulting from drilling fluid flow acting on the obstruction portion is diverted primarily to a fixed surface of a chamber body of the chamber;

a piston located at a lower portion of the chamber, a base of the piston being directly exposed to the drilling fluid, so that pressure exerted by the drilling fluid is transmitted to the hydraulic oil within the chamber, thereby maintaining an approximate hydrostatic balance between oil pressure inside the chamber and a drilling fluid pressure outside the chamber;

a motor and a gearbox assembly operatively coupled to a linear actuator for converting rotary motion into axial displacement of the piston, wherein a power rating of the motor and a gearbox ratio are selected so that the linear actuator is capable of moving the piston by a predetermined distance within either (a) a half-period of a highest frequency utilized for pressure signal encoding, or (b) a minimum time required to fully open or close the respective drilling fluid flow passage for individual pressure pulse generation;

a controller programmed to regulate movement of the two or more reciprocating members, controlling obstruction of the drilling fluid flow passages to produce pressure fluctuation waves, wherein the controller is configured to select and implement a signal encoding scheme chosen from at least one of: (i) alphabet frequencies combinatorial encoding, (ii) carrier frequency modulation, or (iii) single pulse sequence generation, and further configured to change the signal encoding scheme or adjust parameters of the signal encoding scheme in response to downlinking instructions received from a surface, wherein the controller is capable of operating the hydrostatically compensated modulator assembly to generate pressure signals sufficient for high-speed data transmission.

2. The hydrostatically compensated modulator assembly of claim 1, wherein each reciprocating member of the two or more reciprocating members comprises a cylinder positioned substantially perpendicular to the wellbore axis, and the obstruction portion comprises a restrictor plate operatively connected to the cylinder.

3. The hydrostatically compensated modulator assembly of claim 2, wherein the restrictor plate is structured and configured to enable partial or complete obstruction of the respective drilling fluid flow passage during operation, and wherein the operative connection between the cylinder and restrictor plate transmits lateral movement while permitting axial freedom of relative motion, wherein the restrictor plate moves with respect to a fixed chamber surface, and a gap of 0.05-0.1 mm is maintained to prevent fluid bypass.

4. The hydrostatically compensated modulator assembly of claim 3, wherein kinetic energy from drilling fluid flow acting on the restrictor plate is diverted primarily to the fixed chamber surface, wherein the motor and gearbox assembly are housed in a lubricant-filled housing and coupled to a mechanical conversion mechanism for converting rotary motion into linear movement along the wellbore axis, and wherein the mechanical conversion mechanism comprises a cylinder with an inclined groove of angle $\alpha$, enabling the output shaft of the piston to move exclusively in the axial direction as the cylinder oscillates for matching amplitude and direction of reciprocation.

5. The hydrostatically compensated modulator assembly of claim 1, wherein the controller is configured to operate the motor in an energy regeneration mode during at least one of (a) deceleration as the two or more reciprocating members move out of the chamber, or (b) acceleration as the two or more reciprocating members move into the chamber, with regenerated energy stored in a capacitor bank for subsequent use during signal generation, and wherein energy for actuator operation and signal generation is supplemented by regenerated power from fluid-induced movements.

6. The hydrostatically compensated modulator assembly of claim 1, wherein the hydrostatically compensated modulator assembly is configured to calculate maximum travel distances of the piston and the two or more reciprocating members according to $Sp \times Lp = M \times Scyl \times Lcyl$, where Sp is a cross-sectional area of the piston, Lp is a travel distance of the piston, Scyl is a cross-sectional area of each cylinder, Lcyl is a travel distance of each cylinder, and M is a number of reciprocating members.

7. The hydrostatically compensated modulator assembly of claim 1, wherein the motor and the gearbox assembly are configured to generate a maximum pressure, Pmax, in the hydraulic oil chamber sufficient to overcome expected external pressure and frictional losses, and wherein Pmax is calculated as $Pmax = Pcomp_max + Pflow_diff_max + Psignal_max + Pfrictions$, where Pcomp max is a maximum compensatory pressure, Pflow_diff_max is a maximum flow-induced differential, Psignal_max is a maximum signal pressure amplitude, and Pfrictions is a pressure needed to overcome frictional losses; and wherein Pcomp_max is calculated as $Pcomp_max = (TVD \times \rho \times A)/1000$, where TVD is true vertical depth, $\rho$ is a density of the drilling fluid, and A is a cross-sectional area of the piston.

8. The hydrostatically compensated modulator assembly of claim 1, wherein at least one of (i) the obstruction portion comprises a substantially flat surface perpendicular to the direction of drilling fluid flow, and wherein each of the two or more reciprocating members, the obstruction portion, and their operative connection are made from wear-resistant material selected to ensure long-term durability in drilling environment, or (ii) the chamber is dimensioned and the piston is sized such that hydrostatic pressure balance is maintained for a range of drilling fluid densities and depths encountered during operation.

9. The hydrostatically compensated modulator assembly of claim 1, wherein the controller is programmed to evaluate telemetry signal quality and, if required, automatically change the encoding scheme or adjust its parameters responsive to downlinking instructions or real-time telemetry performance, and wherein the controller is configured to store a preselected encoding scheme and switch to alternative encoding if adverse transmission conditions are detected during operation.

10. The hydrostatically compensated modulator assembly of claim 1, wherein at least one of (i) the obstruction portions are configured to allow sequential or simultaneous actuation of multiple passages, thereby supporting multiplexed pressure signaling for improved data rates, (ii) the controller is configured to implement error detection and correction algorithms for pressure signal transmission based on feedback from received telemetry data, or (iii) the hydrostatically compensated modulator assembly comprises secondary seals and guide elements positioned to further prevent unintentional bypass of drilling fluid around the obstruction portions during signal generation.

11. A method for generating pressure wave fluctuations in drilling fluid flow, the method comprising:

installing a hydrostatically compensated modulator assembly with a housing having two or more drilling fluid flow passages, each passage of the two or more drilling fluid flow passages configured as either (a) a gap between an inner surface of the housing and an outer surface of a chamber, or (b) an elongated slot in a supporting plate fastened to the chamber within the housing;

filling the chamber within the housing with hydraulic oil;

disposing two or more reciprocating members substantially perpendicular to a wellbore axis and at least partially within the chamber, each reciprocating member of the two or more reciprocating members operatively associated with a respective drilling fluid flow passage and operatively connecting to an obstruction portion positioned to partially or completely obstruct the drilling fluid flow passage during operation, wherein said connection transmits lateral movement from the reciprocating member to the obstruction portion for obstruction of the passage while permitting axial freedom of relative motion, such that kinetic energy from drilling fluid flow acting on the obstruction portion is diverted primarily to a fixed surface of a chamber body;

exposing a piston at a lower portion of the chamber, a base of the piston being directly exposed to drilling fluid, so that pressure exerted by the drilling fluid is transmitted to the hydraulic oil within the chamber, thereby maintaining an approximate hydrostatic balance between oil pressure inside the chamber and a drilling fluid pressure outside the chamber;

operating a motor and a gearbox assembly coupled to a linear actuator to move the piston by converting rotary motion into axial displacement, wherein a power rating of the motor and a gearbox ratio are selected so that the linear actuator moves the piston by a predetermined distance within either (a) a half-period of a highest frequency utilized for pressure signal encoding, or (b) a minimum time required to fully open or close the respective drilling fluid flow passage for pressure pulse generation;

regulating movement of the two or more reciprocating members using a controller, so that obstruction of the drilling fluid flow passages generates pressure fluctuation waves in the drilling fluid, wherein the controller selects and implements a signal encoding scheme chosen from at least one of: (i) alphabet frequencies combinatorial encoding, (ii) carrier frequency modulation, or (iii) single pulse sequence generation, and further changes the signal encoding scheme or parameters of the signal encoding scheme in response to downlinking instructions received from a surface, wherein the controller is capable of operating the hydrostatically compensated modulator assembly to generate pressure signals sufficient for high-speed data transmission.

12. The method of claim 11, wherein each reciprocating member of the two or more reciprocating members comprises a cylinder positioned substantially perpendicular to the wellbore axis, and the obstruction portion comprises a restrictor plate operatively connected to the cylinder.

13. The method of claim 12, wherein the restrictor plate is structured and configured to enable partial or complete obstruction of the respective drilling fluid flow passage during operation, the operative connection transmits lateral movement while permitting axial freedom, and wherein the restrictor plate moves with respect to a fixed chamber surface, maintaining a gap of 0.05-0.1 mm to prevent fluid bypass.

14. The method of claim 13, wherein kinetic energy from drilling fluid flow acting on the restrictor plate is diverted primarily to the fixed chamber surface, and wherein the motor and gearbox assembly are housed in a lubricant-filled housing and coupled to a mechanical conversion mechanism for converting rotary motion into linear movement along the wellbore axis, and wherein the mechanical conversion mechanism comprises a cylinder with an inclined groove of angle $\alpha$, enabling the output shaft of the piston to move exclusively in the axial direction as the cylinder oscillates for matching amplitude and direction of reciprocation.

15. The method of claim 11, further comprising operating the controller to provide energy regeneration during at least one of (a) deceleration of the two or more reciprocating members as they move out of the chamber, or (b) acceleration of the two or more reciprocating members as they move into the chamber, with regenerated energy stored in a capacitor bank for subsequent use during signal generation, and wherein energy for actuator operation and signal generation is supplemented by regenerated power from fluid-induced movements.

16. The method of claim 11, further comprising calculating maximum travel distances of the piston and the two or more reciprocating members according to $Sp \times Lp = M \times Scyl \times Lcyl$, where Sp is a cross-sectional area of the piston, Lp is a travel distance of the piston, Scyl is a cross-sectional area of each cylinder, Lcyl is a travel distance of each cylinder, and M is a number of reciprocating members.

17. The method of claim 11, wherein the motor and the gearbox assembly are operated to generate a maximum pressure, Pmax, in the hydraulic oil chamber sufficient to overcome expected external pressure and frictional losses, and wherein Pmax is calculated as $Pmax = Pcomp_max + Pflow_diff_max + Psignal\ max + Pfrictions$, where Pcomp_max is a maximum compensatory pressure, Pflow_diff_max is a maximum flow-induced differential, Psignal_max is a maximum signal pressure amplitude, and Pfrictions is a pressure needed to overcome frictional losses; and wherein $Pcomp_max = (TVD \times \rho \times A)/1000$, where TVD is true vertical depth, $\rho$ is a density of the drilling fluid, and A is a cross-sectional area of the piston.

18. The method of claim 11, wherein at least one of (i) the obstruction portion comprises a substantially flat surface perpendicular to the direction of drilling fluid flow, wherein each of the two or more reciprocating members, the obstruction portion, and operative connection are made from wear-resistant material selected to ensure long-term durability in the drilling environment, or (ii) the chamber is dimensioned and the piston is sized such that hydrostatic pressure balance is maintained for a range of drilling fluid densities and depths encountered during operation.

19. The method of claim 11, further comprising programming the controller to evaluate telemetry signal quality and, if required, automatically change the encoding scheme or adjust its parameters in response to downlinking instructions or real-time telemetry performance, and comprising storing a preselected encoding scheme in the controller and switching to an alternative encoding if adverse transmission conditions are detected.

20. The method of claim 11, wherein at least one of (i) the obstruction portions are configured to allow sequential or simultaneous actuation of multiple passages to support multiplexed pressure signaling and improved data rates, (ii) the method comprises implementing error detection and correction algorithms for pressure signal transmission based on feedback from received telemetry data, or (iii) the method comprises providing secondary seals and guide elements to prevent bypass of drilling fluid around the obstruction portions during signal generation.

* * * * *